US006827309B1

(12) United States Patent
Newman et al.

(10) Patent No.: US 6,827,309 B1
(45) Date of Patent: Dec. 7, 2004

(54) MOUNTING SYSTEM FOR A WET WIPES DISPENSER

(75) Inventors: William Robert Newman, Neenah, WI (US); John Eugene Peluso, Appleton, WI (US); Herb F. Velazquez, Neenah, WI (US); Yung Hsiang Huang, Appleton, WI (US); Michael John Faulks, Neenah, WI (US); Paige Annette Dellerman, Appleton, WI (US); Steven John Romme, Oshkosh, WI (US); Ligia A. Rivera, Appleton, WI (US); Frederick J. Lang, Neenah, WI (US); Walter Theodore Schultz, Appleton, WI (US); Jeff Lindsay, Appleton, WI (US); Jennifer Cappel Larson, Oshkosh, WI (US); Cherry A. Bochmann, Cleveland, OH (US); Jeffrey M. Kalman, Cleveland Heights, OH (US); Nick E. Stanca, Westlake, OH (US); Gerald P. DeGreen, Windsor, OH (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 309 days.

(21) Appl. No.: 09/659,307

(22) Filed: Sep. 12, 2000

(51) Int. Cl.[7] ..... B65H 75/28
(52) U.S. Cl. ..... 242/580; 242/594.1
(58) Field of Search ..... 242/590, 594.1, 242/595, 598.6, 598.5, 579, 580, 580.1, 419.4

(56) References Cited

U.S. PATENT DOCUMENTS 1,664,392 A 4/1928 Baruch
2,440,974 A 5/1948 Resch (List continued on next page.)

FOREIGN PATENT DOCUMENTS

| | | |
|---|---|---|
| EP | 0 122 809 A1 | 10/1984 |
| EP | 0 251 103 A1 | 1/1988 |
| EP | 0 501 905 A1 | 9/1992 |
| EP | 0 608 460 A1 | 8/1994 |
| EP | 0 608 460 B1 | 9/1998 |
| EP | 1 023 863 A1 | 8/2000 |
| EP | 1 048 257 A2 | 11/2000 |
| EP | 1 048 257 A3 | 11/2000 |
| GB | 990332 | 4/1965 |
| GB | 1324818 | 7/1973 |
| GB | 1 327 954 | 8/1973 |
| GB | 2 357 076 A | 6/2001 |
| WO | WO 93/17933 | 9/1993 |
| WO | WO 96/21388 A1 | 7/1996 |
| WO | WO 97/24054 | 7/1997 |
| WO | WO 98/08763 A1 | 3/1998 |
| WO | WO 99/06311 A2 | 2/1999 |
| WO | WO 99/01536 A1 | 4/1999 |
| WO | WO 00/00071 | 1/2000 |
| WO | WO 00/08998 | 2/2000 |

OTHER PUBLICATIONS

Search Report for Patent Cooperation Treaty application No. PCT/US 01/11195, Date of Mailing Jul. 19, 2001, 7 pages.
Search Report for Patent Cooperation Treaty application No. PCT/US 01/11198, Date of Mailing Jul. 19, 2001, 7 pages.

(List continued on next page.)

*Primary Examiner*—William A. Rivera

(57) ABSTRACT

There is provided a mounting system for an apparatus for dispensing wet wipes. The system may include a dispenser, a mounting assembly, a backing plate, and arms. The dispenser has the ability to be mounted to a surface by applied pressure or by conventional fastening. The mounting assembly may securely yet removably hold the dispensing apparatus to the surface.

31 Claims, 23 Drawing Sheets

U.S. PATENT DOCUMENTS

| | | | |
|---|---|---|---|
| 3,310,353 | A | 3/1967 | Cordis |
| 3,368,522 | A | 2/1968 | Cordis |
| 3,532,210 | A | 10/1970 | Minion et al. |
| 3,568,635 | A | 3/1971 | Poitras et al. |
| 3,592,161 | A | 7/1971 | Hoffmann |
| 3,603,519 | A | 9/1971 | Brown |
| 3,633,838 | A | 1/1972 | Krueger |
| 3,656,699 | A | 4/1972 | Schnyder et al. |
| 3,713,170 | A | 1/1973 | Kaufman |
| 3,729,145 | A | 4/1973 | Koo et al. |
| 3,754,804 | A | 8/1973 | Cushman |
| 3,756,483 | A | 9/1973 | Schraeder |
| 3,771,739 | A | 11/1973 | Nelson |
| 3,775,801 | A | 12/1973 | Walker |
| 3,780,908 | A | 12/1973 | Fitzpatrick et al. |
| 3,784,055 | A | 1/1974 | Anderson |
| 3,788,573 | A | 1/1974 | Thomson et al. |
| 3,795,355 | A | 3/1974 | Gerstein |
| 3,806,055 | A | 4/1974 | Bauman |
| 3,824,953 | A | 7/1974 | Boone |
| 3,836,044 | A | 9/1974 | Tilp et al. |
| 3,836,045 | A | 9/1974 | Duhy et al. |
| 3,837,595 | A | 9/1974 | Boone |
| 3,841,466 | A | 10/1974 | Hoffman et al. |
| 3,843,017 | A | 10/1974 | Harrison |
| 3,848,822 | A | 11/1974 | Boone |
| 3,865,271 | A | 2/1975 | Gold |
| 3,890,622 | A | 6/1975 | Alden |
| 3,913,522 | A | 10/1975 | Light |
| 3,943,859 | A | 3/1976 | Boone |
| 3,949,947 | A | 4/1976 | Youngquist et al. |
| 3,967,756 | A | 7/1976 | Barish |
| 3,970,215 | A | 7/1976 | McLaren et al. |
| 3,982,659 | A | 9/1976 | Ross |
| 3,986,479 | A | 10/1976 | Bonk |
| 3,994,417 | A | 11/1976 | Boedecker |
| 3,995,582 | A | 12/1976 | Douglas |
| 4,002,264 | A | 1/1977 | Marchesani |
| 4,004,687 | A | 1/1977 | Boone |
| 4,025,004 | A | 5/1977 | Massey |
| 4,043,519 | A | 8/1977 | Suzuki et al. |
| 4,069,789 | A | 1/1978 | Fukagawa et al. |
| 4,071,200 | A | 1/1978 | Stone |
| 4,098,469 | A | 7/1978 | McCarthy |
| 4,101,026 | A | 7/1978 | Bonk |
| 4,106,433 | A | 8/1978 | Fernando et al. |
| 4,106,616 | A | 8/1978 | Boone |
| 4,106,617 | A | 8/1978 | Boone |
| 4,114,824 | A | 9/1978 | Danielak |
| 4,124,259 | A | 11/1978 | Harris |
| 4,131,195 | A | 12/1978 | Worrell, Sr. |
| 4,135,199 | A | 1/1979 | Kurland et al. |
| 4,135,678 | A | 1/1979 | Williams |
| 4,138,034 | A | 2/1979 | McCarthy |
| 4,179,078 | A | 12/1979 | Mansfield |
| 4,191,317 | A | 3/1980 | Harkins |
| 4,205,802 | A | 6/1980 | Economakis |
| 4,219,129 | A | 8/1980 | Sedwick |
| 4,222,621 | A | 9/1980 | Greenlee et al. |
| 4,235,333 | A | 11/1980 | Boone |
| 4,244,493 | A | 1/1981 | Harrison |
| 4,260,117 | A | 4/1981 | Perrin et al. |
| 4,274,573 | A | 6/1981 | Finkelstein |
| 4,294,389 | A | 10/1981 | Falk et al. |
| 4,328,907 | A | 5/1982 | Beard |
| 4,353,480 | A | 10/1982 | McFadyen |
| 4,363,454 | A | 12/1982 | Mohar |
| 4,375,874 | A | 3/1983 | Leotta et al. |
| 4,383,656 | A | 5/1983 | Campbell |
| 4,401,248 | A | 8/1983 | Helms |
| 4,411,374 | A | 10/1983 | Hotchkiss |
| 4,425,012 | A | 1/1984 | Kley |
| 4,427,159 | A | 1/1984 | Miller et al. |
| 4,428,497 | A | 1/1984 | Julius et al. |
| 4,432,504 | A | 2/1984 | Pace |
| 4,436,221 | A | 3/1984 | Margulies |
| 4,447,015 | A | 5/1984 | Peterson |
| 4,453,634 | A | 6/1984 | Blumenthal |
| 4,463,912 | A | 8/1984 | Grunerud |
| 4,467,974 | A | 8/1984 | Crim |
| 4,526,291 | A | 7/1985 | Margulies |
| 4,535,912 | A | 8/1985 | Bonk |
| 4,550,855 | A | 11/1985 | Harrison |
| 4,564,148 | A | 1/1986 | Wentworth |
| 4,566,606 | A | 1/1986 | Kling |
| 4,570,820 | A | 2/1986 | Murphy |
| 4,601,938 | A | 7/1986 | Deacon et al. |
| 4,607,809 | A | 8/1986 | Sineni et al. |
| 4,648,530 | A | 3/1987 | Granger |
| 4,659,028 | A | 4/1987 | Wren |
| 4,662,576 | A | 5/1987 | Paul |
| 4,662,577 | A | 5/1987 | Lewis |
| 4,667,890 | A | 5/1987 | Gietman, Jr. |
| 4,684,075 | A | 8/1987 | Francis |
| 4,690,345 | A | 9/1987 | Cotey |
| 4,721,264 | A | 1/1988 | Muscarello |
| 4,735,317 | A | 4/1988 | Sussman et al. |
| 4,756,485 | A | 7/1988 | Bastian et al. |
| 4,775,109 | A | 10/1988 | Tegg |
| 4,784,290 | A | 11/1988 | Howard |
| 4,790,490 | A | 12/1988 | Chakravorty |
| 4,807,823 | A | 2/1989 | Wyant |
| 4,826,063 | A | 5/1989 | Ban |
| 4,828,193 | A | 5/1989 | Galbraith |
| 4,830,301 | A | 5/1989 | Miller |
| 4,834,316 | A | 5/1989 | DeLorean |
| 4,836,368 | A | 6/1989 | Cotton |
| 4,836,462 | A | 6/1989 | Bruss |
| 4,846,412 | A | 7/1989 | Morand |
| 4,860,893 | A | 8/1989 | Kaufman |
| D303,890 | S | 10/1989 | Pilot |
| 4,877,133 | A | 10/1989 | Klenter et al. |
| 4,883,197 | A | 11/1989 | Sanchez et al. |
| 4,884,690 | A | 12/1989 | Klenter et al. |
| 4,890,205 | A | 12/1989 | Shaffer |
| 4,913,365 | A | 4/1990 | Shamass |
| 4,936,452 | A | 6/1990 | Pauley |
| D311,106 | S | 10/1990 | Jaber |
| 4,978,095 | A | 12/1990 | Phillips |
| 4,984,530 | A | 1/1991 | Dutton |
| 4,989,800 | A | 2/1991 | Tritch |
| 4,991,538 | A | 2/1991 | Davids et al. |
| 5,000,393 | A | 3/1991 | Madsen |
| 5,009,313 | A | 4/1991 | Morand |
| 5,012,986 | A | 5/1991 | Needle |
| 5,029,787 | A | 7/1991 | Florentin |
| 5,049,440 | A | 9/1991 | Bornhoeft, III et al. |
| 5,050,737 | A | 9/1991 | Joslyn et al. |
| 5,104,054 | A | 4/1992 | Latham |
| 5,137,173 | A | 8/1992 | Hughes et al. |
| 5,141,171 | A | 8/1992 | Yang |
| 5,145,091 | A | 9/1992 | Meyers |
| D329,978 | S | 10/1992 | Ryan |
| 5,154,496 | A | 10/1992 | Campbell et al. |
| 5,170,958 | A | 12/1992 | Brown |
| 5,172,840 | A | 12/1992 | Bloch et al. |
| 5,192,044 | A | 3/1993 | Baskin |
| 5,193,759 | A | 3/1993 | Bigelow et al. |
| 5,195,689 | A | 3/1993 | Beer et al. |
| 5,207,367 | A | 5/1993 | Dunn et al. |
| 5,219,092 | A | 6/1993 | Morand |

5,228,632 A 7/1993 Addison et al.
5,253,818 A 10/1993 Craddock
5,255,800 A 10/1993 Kelly
D342,635 S 12/1993 Carter et al.
D342,852 S 1/1994 Welch
5,277,375 A 1/1994 Dearwester
5,310,262 A 5/1994 Robison et al.
5,311,986 A 5/1994 Putz
5,312,883 A 5/1994 Komatsu et al.
5,317,063 A 5/1994 Komatsu et al.
D347,534 S 6/1994 Gottselig
5,335,811 A 8/1994 Morand
5,368,157 A 11/1994 Gasparrini et al.
5,370,336 A 12/1994 Whittington
5,374,008 A 12/1994 Halvorson et al.
5,384,189 A 1/1995 Kuroda et al.
5,392,945 A 2/1995 Syrek
5,400,982 A 3/1995 Collins
5,409,181 A 4/1995 Patrick
5,439,521 A 8/1995 Rao
5,443,084 A 8/1995 Saleur
5,449,127 A 9/1995 Davis
D362,773 S 10/1995 Kartchner
5,456,420 A 10/1995 Frazier
5,456,421 A 10/1995 Reed
5,462,197 A 10/1995 Pound
5,464,096 A 11/1995 Hurwitz
5,464,170 A 11/1995 Mitchell et al.
5,480,060 A 1/1996 Blythe
5,494,250 A 2/1996 Chen
5,495,997 A 3/1996 Moody
5,501,323 A 3/1996 Denesha et al.
5,509,593 A 4/1996 Bloch et al.
5,520,308 A 5/1996 Berg, Jr. et al.
5,526,973 A 6/1996 Boone et al.
5,533,621 A 7/1996 Schoal, Jr.
5,540,332 A 7/1996 Kopacz et al.
5,542,568 A 8/1996 Julius
5,560,514 A 10/1996 Frazier
5,588,615 A 12/1996 Batts
D377,284 S 1/1997 Farrow et al.
5,598,987 A 2/1997 Wachowicz
5,604,992 A 2/1997 Robinson
5,605,250 A 2/1997 Meiron et al.
5,609,269 A 3/1997 Behnke et al.
5,618,008 A 4/1997 Dearwester et al.
5,620,148 A 4/1997 Mitchell
5,624,025 A 4/1997 Hixon
5,630,526 A 5/1997 Moody
5,630,563 A 5/1997 Meisner et al.
5,631,317 A 5/1997 Komatsu et al.
5,642,810 A 7/1997 Warner et al.
5,649,676 A 7/1997 Lord
D381,851 S 8/1997 Sharpe
5,653,403 A 8/1997 Ritchey
5,655,661 A 8/1997 Rigby
5,660,313 A 8/1997 Newbold
5,660,636 A 8/1997 Shangold et al.
5,667,092 A 9/1997 Julius et al.
5,669,576 A 9/1997 Moody
5,672,206 A 9/1997 Gorman
D386,025 S 11/1997 Mervar et al.
5,687,875 A 11/1997 Watts et al.
D387,590 S 12/1997 Cameron et al.
5,697,576 A 12/1997 Bloch et al.
5,697,577 A 12/1997 Ogden
5,704,565 A 1/1998 Cheng
5,704,566 A 1/1998 Schutz et al.
5,765,717 A 6/1998 Gottselig
D397,265 S 8/1998 Badillo
RE35,976 E 12/1998 Gasparrini et al.
5,848,762 A 12/1998 Reinheimer et al.
5,868,275 A 2/1999 Moody
5,868,335 A 2/1999 Lebrun
5,868,344 A 2/1999 Melnick
5,868,345 A 2/1999 Beisser
5,868,346 A 2/1999 Cobos
5,868,347 A 2/1999 Paul et al.
5,875,985 A 3/1999 Cohen et al.
5,887,759 A 3/1999 Ayigbe
5,887,818 A 3/1999 Kelley
5,893,531 A 4/1999 Taylor et al.
5,897,074 A 4/1999 Marino
5,901,921 A 5/1999 Perlsweig
5,904,316 A 5/1999 Dunning et al.
5,914,177 A 6/1999 Smith, III et al.
5,924,617 A 7/1999 LaCount et al.
D412,439 S 8/1999 Cormack
5,938,013 A 8/1999 Palumbo et al.
5,950,960 A 9/1999 Marino
5,951,762 A 9/1999 Shangold et al.
5,958,187 A 9/1999 Bhat et al.
5,964,351 A 10/1999 Zander
5,967,452 A 10/1999 Wilder
5,971,138 A 10/1999 Soughan
5,971,142 A 10/1999 Jones
D416,794 S 11/1999 Cormack
D417,109 S 11/1999 Johnson et al.
5,979,821 A 11/1999 LaCount et al.
5,992,718 A 11/1999 Zaranck
D417,987 S 12/1999 Valazquez
6,000,538 A 12/1999 Lee
6,000,658 A 12/1999 McCall, Jr.
6,007,019 A 12/1999 Lynch
6,010,001 A 1/2000 Osborn, III
6,015,125 A 1/2000 Fischer
6,024,216 A 2/2000 Shillington et al.
6,024,217 A 2/2000 Ponsi et al.
6,024,323 A 2/2000 Palermo, Jr.
D421,691 S 3/2000 Hoblitz
6,036,134 A 3/2000 Moody
D422,437 S 4/2000 Conran et al.
6,047,920 A 4/2000 Dearwester et al.
6,056,233 A 5/2000 Von Schenk
6,056,235 A 5/2000 Brozinsky
6,059,882 A 5/2000 Steinhardt et al.
6,059,928 A 5/2000 Van Luu et al.
6,068,118 A 5/2000 Calloway
6,070,821 A 6/2000 Mitchell
6,079,603 A 6/2000 Smegal
6,082,664 A 7/2000 Phelps et al.
6,085,899 A 7/2000 Thorsbakken
6,092,690 A 7/2000 Bitowft et al.
6,092,758 A 7/2000 Gemmell
6,092,759 A 7/2000 Gemmell et al.
D429,282 S 8/2000 Velazquez et al.
6,098,836 A 8/2000 Gottselig
6,121,165 A 9/2000 Mackey et al.
6,138,939 A 10/2000 Phelps et al.
6,158,614 A 12/2000 Haines et al.

OTHER PUBLICATIONS

Search Report for Patent Cooperation Treaty application No. PCT/US 01/11620, Date of Mailing Jul. 19, 2001, 7 pages.

Search Report for Patent Cooperation Treaty application No. PCT/US 01/11686, Date of Mailing Jul. 11, 2001, 5 pages.

Search Report for Patent Cooperation Treaty application No. PCT/US 01/11131, Date of Mailing Jul. 23, 2001, 7 pages.

Search Report for Patent Cooperation Treaty application No. PCT/US 01/11447, Date of Mailing Jul. 19, 2001, 6 pages.

Search Report for Patent Cooperation Treaty application No. PCT/US 01/11467, Date of Mailing Jul. 19, 2001, 7 pages.
Search Report for Patent Cooperation Treaty application No. PCT/US 01/12091, Date of Mailing Jul. 9, 2001, 4 pages-.Search Report for Patent Cooperation Treaty application No. PCT/US 01/14113, Date of Mailing Jul. 19, 2001, 6 pages.
Search Report for Patent Cooperation Treaty application No. PCT/US 01/40677, Date of Mailing Jul. 19, 2001, 6 pages.
Letter, dated Apr. 4, 1998, and accompanying drawings.
Invitation to Pay Additional Fees for Patent Cooperation Treaty application No. PCT/US 01/27698, Date of Mailing Jan. 10, 2002, 7 pages.
Search Report for Patent Cooperation Treaty application No. PCT/US 01/28520, Date of Mailing Mar. 4, 2002, 7 pages.
Search Report for Patent Cooperation Treaty application No. PCT/US01/27698, Date of Mailing Apr. 5, 2002, 4 pages.
Derwent World Patent Database abstract of DE 313237: Description of M. Scheepe, "Refill Pack of Moisture–Impregnated Tissues.".
Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand.".
Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder.".
Kotler, Philip, *Marketing Management*, Prentice Hall, Upper Saddle River, NJ, 2000, p. 456–483.
PCT search report for application Ser. No.: PCT/US00/11284, dated Jul. 28, 2000.
Images of Moist Mates product—dispenser and wipes, approximately 1996.
Images of Moist Mates product—dispenser, approximately 2000.
Images of Moist Mates product—refill wipes, approximately 2000.

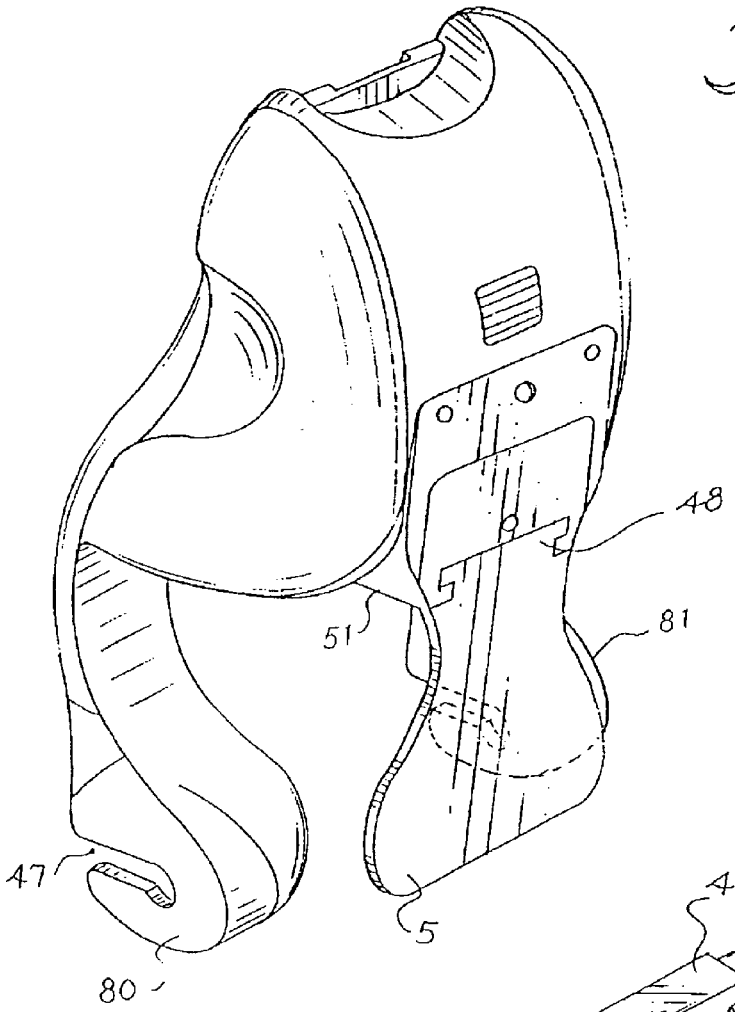
Fig. 11
Fig. 12
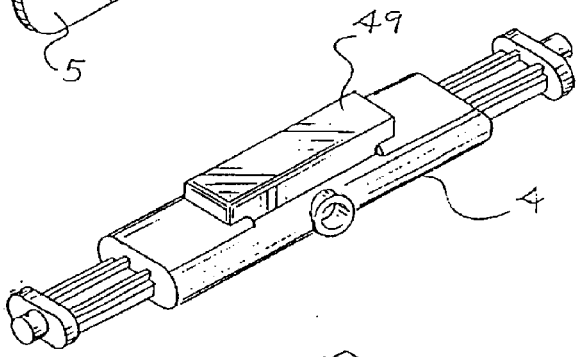
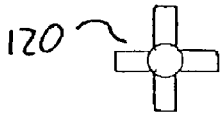
Fig. 13A
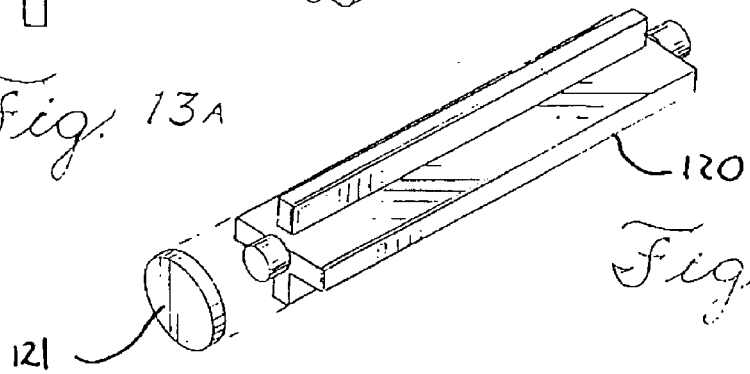
Fig. 13

Fig. 17
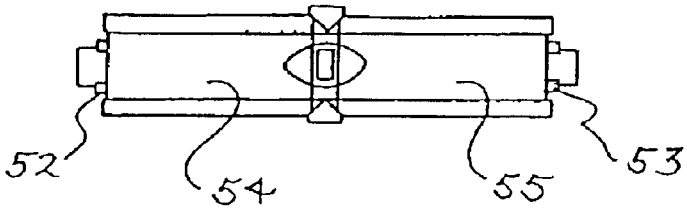
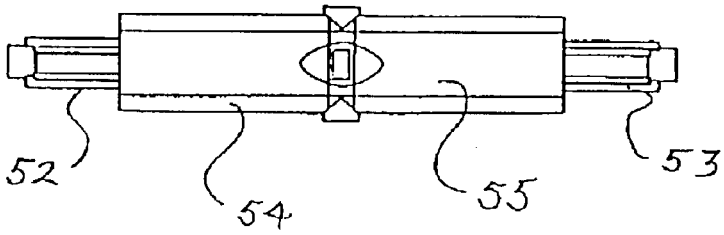
Fig. 18

Fig. 19
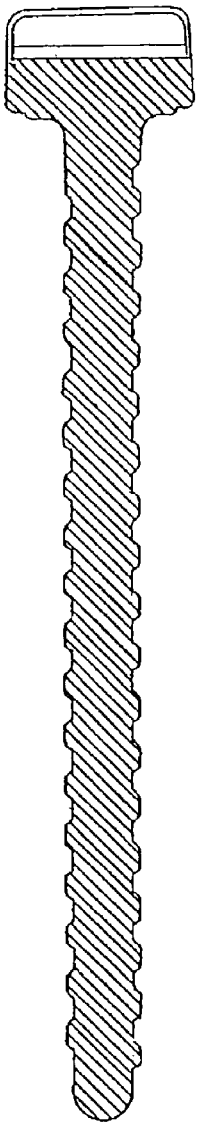
Fig. 20
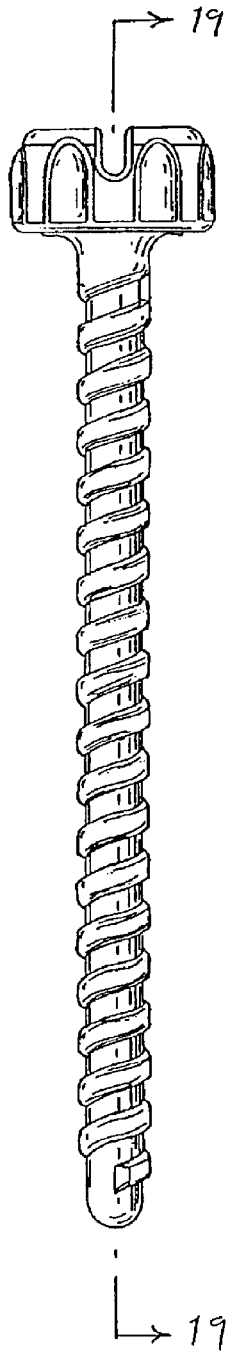
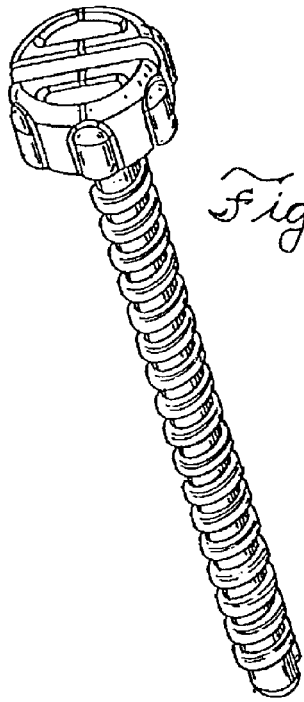
Fig. 21
Fig. 22
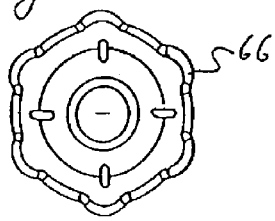
Fig. 23
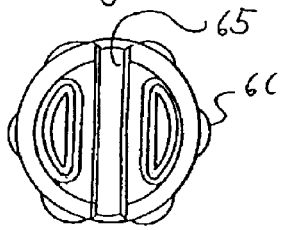

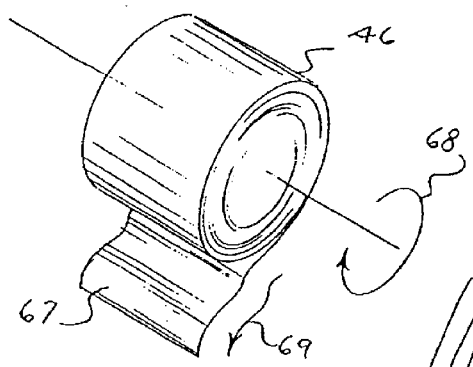
Fig. 24
Fig. 25
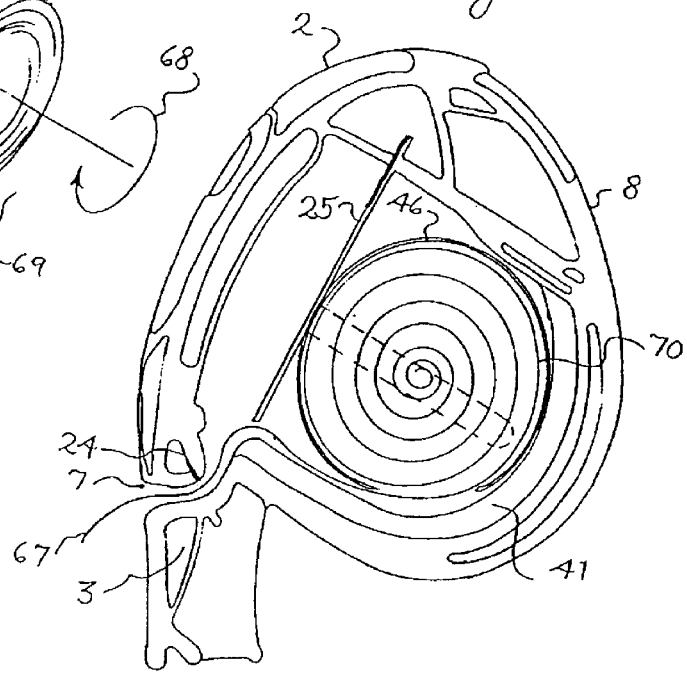
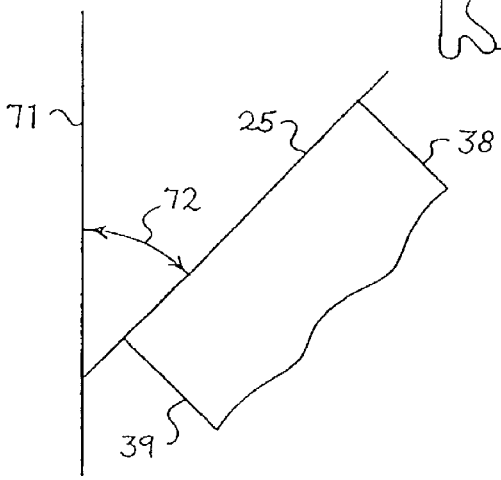
Fig. 27
Fig. 26
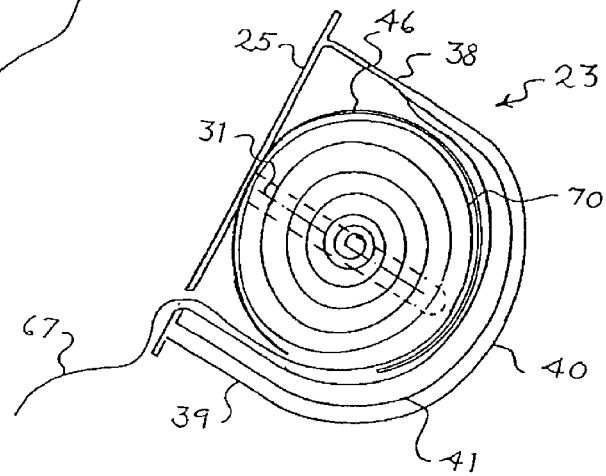

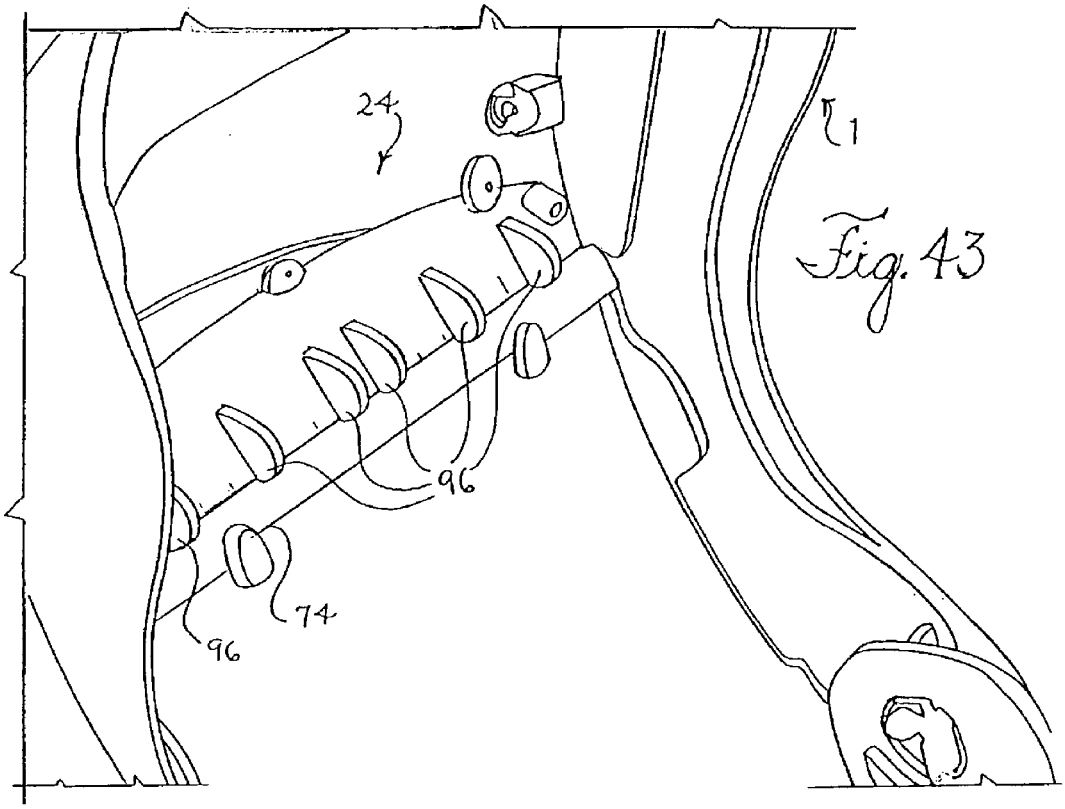
Fig. 43
Fig. 44
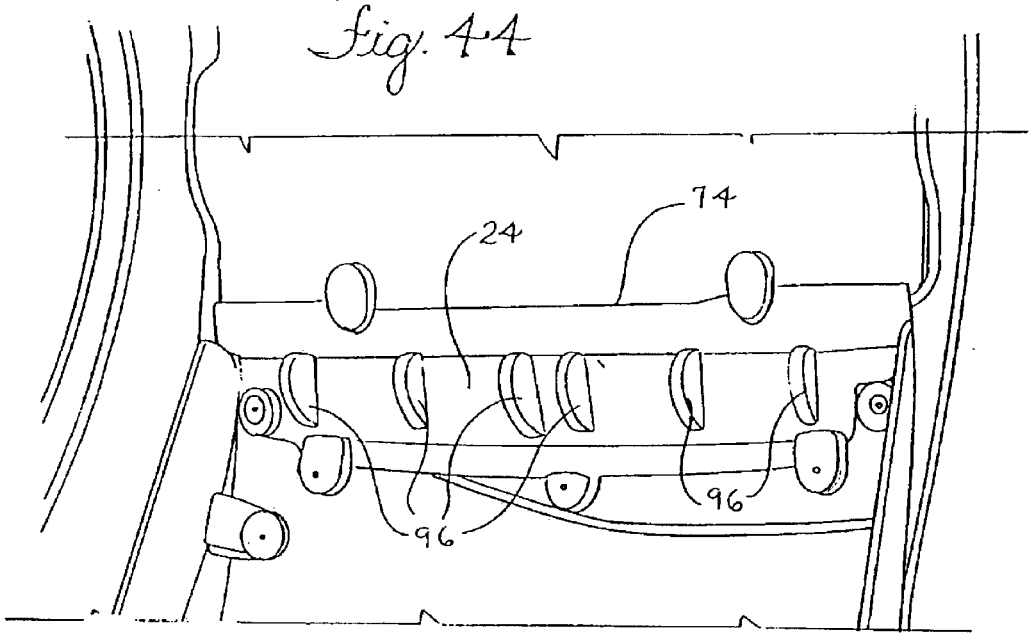

MOUNTING SYSTEM FOR A WET WIPES DISPENSER

FIELD OF THE INVENTION

This invention relates to the use of wet or premoistened products alone or in conjunction with other products or systems to dispense such products.

BACKGROUND OF THE INVENTION

Wet products such as wet wipes have many applications. They may be used with small children and infants when changing diapers, they may be used for household cleaning tasks, they may be used for cleaning hands, they may be used as a bath tissue, they may be used by a caregiver to clean a disabled or incontinent adult, or they may be used in and for a whole host of other applications, where it is advantageous to have a wipe or towel that has some moisture in it.

Wet wipes have been traditionally dispensed in sheet from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be torn off, usually at a perforation, and the lid closed.

Wet wipes can be any wipe, towel tissue or sheet like product including natural fibers, synthetic fibers, synthetic material and combinations thereof, that is wet or moist or becomes wet during use or prior to use. Examples of wet wipes are disclosed in application Ser. Nos. 09/564,449, 09/564,213: 09/565,125; 09/564,837; 09/564,939; 09/564,531; 09/564,268; 09/564,424: 09/564,780; 09/564,212; 09/565,623 all filed May 4, 2000, and application Ser. No. 09/223,999 entitled Ion-Sensitive Hard Water Dispersible Polymers And Applications Therefore, filed Dec. 31, 1998 the disclosures of which are incorporated herein by reference.

SUMMARY OF THE INVENTION

In an embodiment of the present invention, there is provided a dispensing system for dispensing wet wipes, the system comprising a wet wipes dispenser, a mounting assembly and a backing plate. The dispensing system may further comprise tightening means, such as a screw, or a threaded rod, which can exert pressure on the mounting assembly and the backing plate such that the dispenser is fixed to a surface.

In a further embodiment of the present invention, there is provided a back mounting plate for mounting a dispenser to a wall. The backing plate comprises a body member having a top side, a bottom side, a front side, and a back side, and the top side includes means for engaging a wet wipes dispenser. The backing plate may be fixed to a surface by an applied pressure or by fastening means.

In a further embodiment of the present invention, there is provided a dispensing system for dispensing wet wipes comprising a wet wipes dispenser and a backing plate and further arms which may support another product, such as a roll of conventional dry bath tissue.

In a further embodiment of the present invention, there is provided a dispensing system for wet wipes wherein the dispenser exerts a dispensing force on the wet wipes as the wipes are dispensed through the gap in the dispenser. The wipes have a tensile strength which is at least twice that of the dispensing force, preferably at least five times that of the dispensing force, more preferably at least seven times that of the dispensing force. The wipes have a tensile strength along their length of at least 300 g/inch, preferably between about 300 g/inch and 600 g/inch. The wipes have a tensile strength along their width of at least 250 g/inch, preferably between about 250 g/inch and 500 g/inch. The wipes have a peel force between about 18 and 50 g/inch, preferably between about 20 and 40 g/inch. The dispensing force is between about 20 and 150 g/inch, preferably between about 30 and 60 g/inch, more preferably less than about 47 g/inch. The wipes are preferably configured in a roll. Preferably, the wipes are configured in a coreless roll and comprise perforations. The perforations may be characterized by a bond length of 0.01 inches, a cut length of 0.03 inches, and a bond spacing of 0.04 inches. The perforations may be characterized by a bond length of 0.02 inches, a cut length of 0.05 inches, and a bond spacing of 0.07 inches. The perforations may be characterized by a bond length of 0.04 inches, a cut length of 0.09 inches, and a bond spacing of 0.13 inches. The detach strength of the wipes, due to the perforations, is at least five times that of the dispensing force, preferably at least seven times that of the dispensing force.

In a further embodiment of the present invention, there is provided a method for dispensing wet wipes comprising: mounting a wet wipes dispenser in the toilet tissue dispenser by means of a mounting assembly, the wet wipes dispenser having wet wipes and a backing plate; securing the wipes dispenser to the toilet tissue dispenser and at least one surface by means of a screw in the mounting assembly; and removing wet wipes from the wipes dispenser.

In a further embodiment of the present invention, there is provided a method for dispensing wet wipes comprising: securing a wet wipes dispenser to a toilet tissue dispenser by applying pressure to the posts of the toilet tissue dispenser and at least one surface by adjusting a screw in a mounting assembly, the dispenser comprising a backing plate; inserting a container of wet wipes; and removing wet wipes from the wipes dispenser.

In a further embodiment of the present invention, there is provided a method for dispensing wet wipes comprising: attaching a wet wipes dispenser to a surface such that the wipes dispenser does not move substantially during use, the wet wipes dispenser comprising a backing plate, wet wipes, an opening, and a moisture barrier means; pulling the wet wipes through the moisture barrier means; and removing wet wipes from the dispenser.

In a further embodiment of the present invention, there is provided a method for dispensing wet wipes comprising: attaching a wet wipes dispenser to a surface such that the wipes dispenser does not move substantially during use, the wet wipes dispenser comprising a backing plate, an opening, and a moisture barrier means; inserting a container of wet wipes into the dispenser; pulling the wet wipes through the moisture barrier means; and removing wet wipes from the dispenser.

In a further embodiment of the present invention, there is provided a method for dispensing wet wipes comprising: mounting a wet wipes dispenser in a toilet tissue dispenser by means of a mounting assembly such that the mounting assembly and dispenser together exert pressure on the posts of the toilet tissue dispenser and on at least one surface, the dispenser comprising a backing plate.

In a further embodiment of the present invention, there is provided a method for dispensing wet wipes comprising: removing a spindle from a toilet tissue dispenser; mounting a wet wipes dispenser in the toilet tissue dispenser by means of a mounting assembly, the dispenser having a movable tray and a backing plate, the mounting assembly having a screw; moving the tray such that the screw is uncovered; and adjusting the screw in the mounting assembly such that the wipes dispenser is secured to the toilet tissue dispenser and at least one surface.

In a further embodiment of the present invention, there is provided a method for dispensing wet wipes comprising: mounting a wet wipes dispenser in the toilet tissue dispenser by means of a mounting assembly; the wet wipes dispenser having wet wipes, a tray, and a backing plate; the mounting assembly having a screw; moving the tray such that the screw is uncovered; securing the wipes dispenser to the toilet tissue dispenser and at least one surface by means of the screw; repositioning the tray in the dispenser; and removing wet wipes from the wipes dispenser.

These embodiments may further comprise engaging the wet wipes dispenser with the posts of the toilet tissue dispenser by means of a mounting assembly; and/or applying pressure to the posts of the toilet tissue dispenser and the at least one surface by adjusting a screw in a mounting assembly. The wipes dispenser may be rigidly, removably, and adjustably secured to the toilet tissue dispenser and at least one surface; the securing may be such that the wipes dispenser does not substantially move over a period of 10 minutes when subjected to a force of at least 500 g, to a force of at least 800 g, and/or to a force of at least 1100 g.

DRAWINGS

FIG. 11 is a perspective rear view of a dispenser and back mounting piece.

FIG. 12 is a view of a mounting assembly.

FIG. 13 is a view of a roller.

FIGS. 15–18 are views of a mounting assembly.

FIGS. 19–23 are views of a screw used in conjunction with the mounting assembly.

FIG. 24 is a perspective view of a roll of wet wipes.

FIG. 25 is a cross section view of a dispenser, a cartridge and a roll of wet wipes.

FIG. 26 is a cross section view of a cartridge and a roll of wet wipes.

FIG. 27 is a cross section view of a cartridge.

FIG. 30 is a view along line A—A of FIG. 28.

FIG. 32 is a view along line A—A of FIG. 31.

FIG. 43 is a perspective view of the inside of a cover.

FIG. 44 is a top view of the inside of a cover.

DETAILED DESCRIPTION OF PRESENTLY PREFERRED EMBODIMENTS OF THE INVENTION

Figure 45:
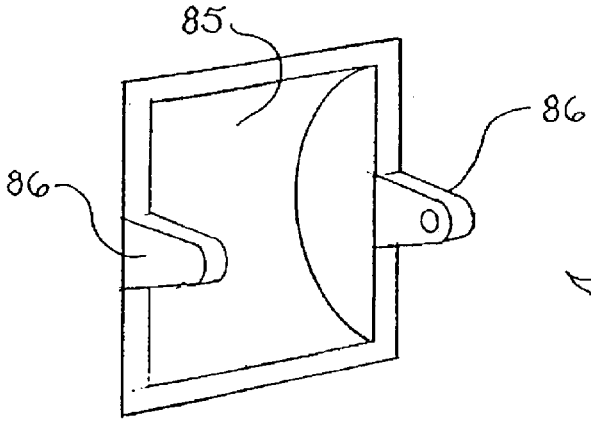
FIG. 45 is a view of a conventional bath tissue holder.
Figure 46:
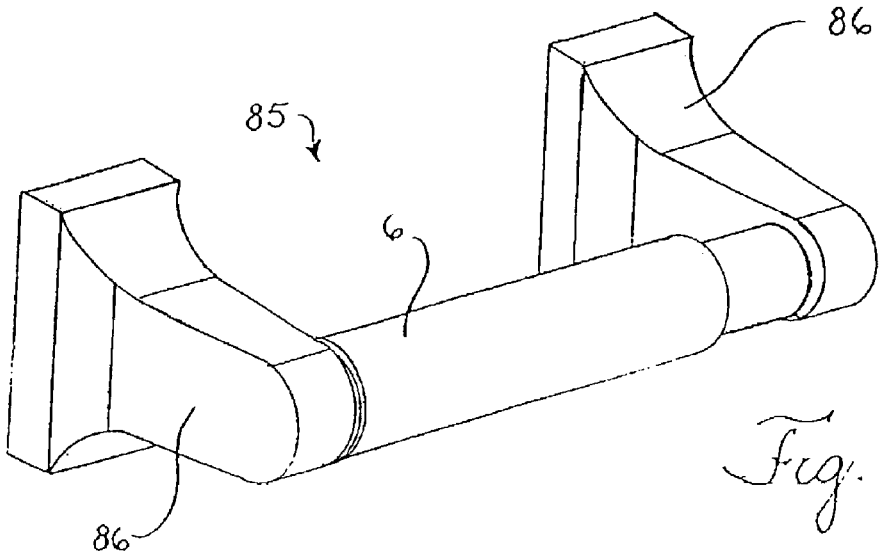
FIG. 46 is a view of a conventional bath holder.
Figure 47:
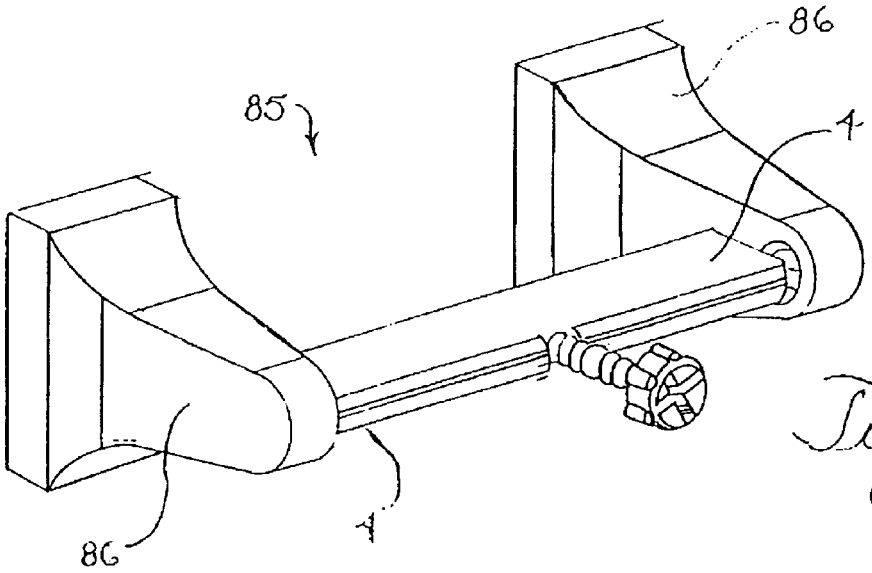
FIG. 47 is a view of a mounting assembly in a conventional bath tissue holder (shown without the dispenser).

In general there is provided a device for mounting a wet wipes dispenser to another surface. That surface may be, by way of example, a wall in a bathroom, a kitchen wall, or a bathroom vanity wall. The device may be used with, or adapted for use with, most any type of wet wipes dispenser, such as the various dispensers illustrated and disclosed herein. The device is ideally adapted to work in conjunction with a conventional bath tissue holder to permit a dispenser to be securely, yet removably attached to the wall. A conventional bath tissue holder is the type that is typically found in a home. Such holders have posts that protrude from the wall and a rod or roller that is positioned between the posts. These holders may also be partially recessed into the wall. Such a holder and a holder with a mounting assembly engaged are illustrated in FIGS. 45–47. The device may also be used in the absence of a conventional bath tissue holder and may be adapted to provide that the dispenser is fixed to the wall.

The device of the present invention, in generality, comprises a plate or rigid member that is large enough to abut against the opening found in a conventional bath tissue holder. In this manner the plate bridges the opening and provides a stable platform to which the dispenser can be attached or affixed. It should be noted that the plate does not have to entirely bridge this opening, it need only be of sufficient size to provide for a rigid enough mounting for the intended or anticipated use of the dispenser. Ideally, the plate may be from about 3 inches (76.2 mm) to about 9 inches (228.6 mm) high (vertical dimension in use) and about 1 inch (25.4 mm) to about 4.5 inches (114.3 mm) wide (horizontal dimension in use), it further may be less than about 10 inches (254.0 mm), less than about 7 inches (177.8 mm) and less than about 4 inches (101.6 mm) high. It, however, may be longer or smaller depending upon the particular application to which it is being put. Presently, a height of about 5 inches (127.0 mm) provides good aesthetic appearance. The plate may be made out of any strong durable material such as plastic, wood, ceramic, porcelain, glass, metal, thermoplastic elastomers, or composite materials. For example, and without limitation, the plate may be made of polypropylene, polyester such as polybutylene terephthalate (Pbt), Pbt glass filled, Pbt 15% glass filled, fiberglass, carbon fiber, or acrylonitrile-butadiene-styrene (ABS).

As described and illustrated herein, the plate may take many shapes and need not be flat or planar, although that shape is presently preferred. A backing plate which is curved may improve the compatibility of the dispenser with a bath tissue holder having an opening as shown in FIG. 45. The plate may be attached to the dispenser in any manner known to those skilled in the art that is strong enough so that the dispenser will have the requisite stability for use. For example, the plate may be integral with the dispenser, the plate and the dispenser may be made from a unitary molded piece, the plate may be attached to the dispenser by way of welds, glue, adhesive or other bonding means, the dispenser may be attached to the plate by mechanical fastening means such as screws, bolts, pins, or tabs and grooves (the latter having the ability to provide a greater degree of removability), or the dispenser may be attached to the plate by hook and loop type fasteners.

In use, a mounting assembly, or other means to engage the posts of a conventional bath tissue holder, is used as an anchor with which a screw, or other tightening means cooperates. Thus, the tightening means, using the mounting means and posts as an anchor, forces the dispenser in combination with the plate against the surfaces of the conventional bath tissue holder and/or the wall next to the conventional bath tissue holder. The dispenser is then held securely against and/or to the conventional bath tissue holder.

Figure 1B:
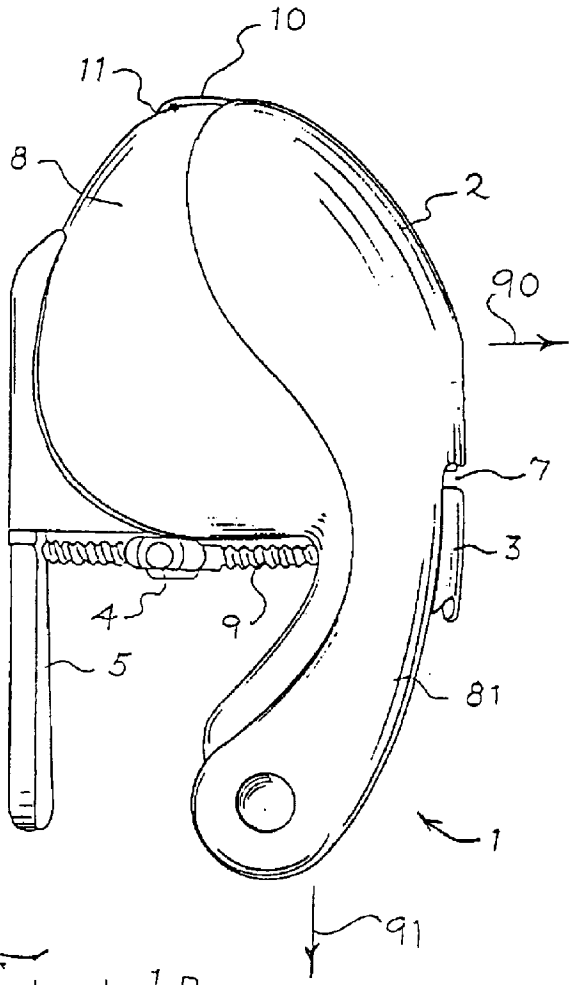
FIG. 1B is a side view of a dispenser and back mounting piece.
Figure 1A:
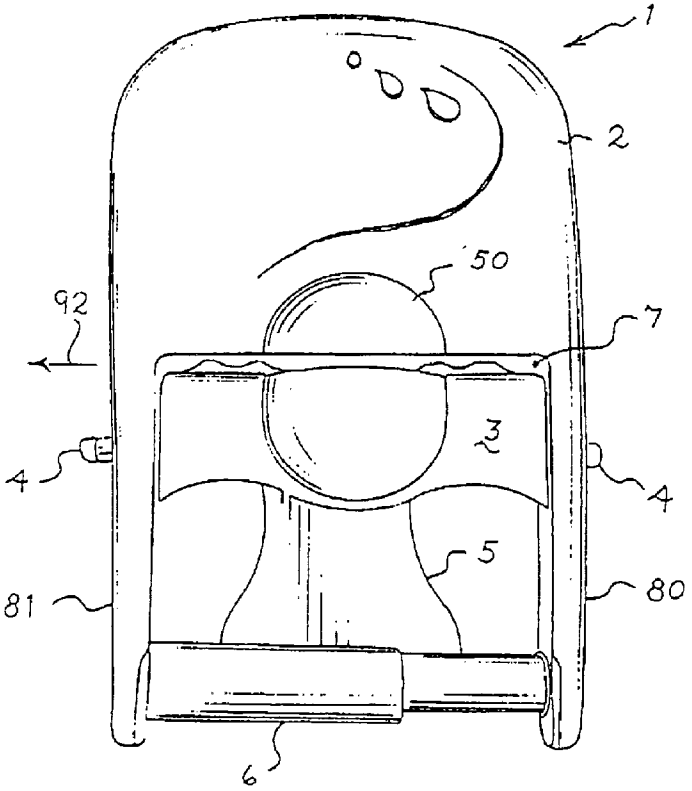
FIG. 1A is a front view of a dispenser and back mounting piece.

The mounting assembly and plate cooperate to provide a manner of affixing the dispenser to a surface, such as a wall, so that when affixed the dispenser is secure to reduce wobbling during use. Thus, the dispenser is held in place during use with little or no wobbling. The reduction or elimination of wobbling may occur under most, if not all, conditions of normal use, such as for example, when wipes or conventional tissue are removed smoothly, roughly, in a slashing manner or by any other common manner of using such products. For example, the dispenser can withstand a normal force shown as arrow 90 in FIG. 1B, a vertical force shown as arrow 91 in FIG. 1B, and a side force shown as arrow 92 in FIG. 1A of 1116.6 g for about 10 minutes without deflecting, moving or wobbling. The dispenser can also be affixed to a surface, such as a wall, by other means such as glue, nails, screws, rivets, magnetic attachments, staples, engaging brackets and pressure mountings.

Additionally, adhesive pads, foam, spacers or tape can be used between the dispenser and the surface to which it is mounted, the plate and the surface to which it is mounted, or both. These items may have adhesive on no sides, one side or preferably both sides. The use of such items further reduces or eliminates any wobble in the dispenser during use and helps to prevent damage to the wall surface.

In an embodiment of this invention, referring to FIGS. 1A through 1F, there is provided a dispenser 1, which may have a front cover 2, a rear or back cover 8, a tray 3, a mounting assembly 4, and a back mounting plate 5. The tray and the rear cover may be separate, separable components, they may be integral, or they may be fixed together or removably mounted together. By way of illustration, ideally the front cover is hingedly attached to the rear cover at or near the tray so that the front cover can swing open for placing wipes in the dispenser and then swing shut. The front cover may also be clear, translucent, or have a window in it to provide a way to visually determine the amount of wipes in the dispenser. The tray and the front cover form a gap 7, through which a wet wipe can extend. That portion of the wipe extending through the gap may be referred to as a tail. The tray and front cover may additionally have recesses 50, that form an indentation that provides a finger hold, or point where a user can grasp the wet wipe to pull it from the dispenser. Although optional, this dispenser is also provided with a roller 6 (not shown in FIG. 1E) for mounting and dispensing conventional bath tissue or other rolled products. The dispenser may also have arms 80 and 81 that extend from the dispenser to hold the spindle or roller 6 for supporting a roll of another product, such as dry or conventional bath tissue. The arms may also support a means of dispensing, storing, containing or mounting a product such as wipes, toilet tissue, or the like. For example, the arms may support a shelf which may in turn support a container of wet wipes having the same or a different composition from that of the wipes in the dispenser.

The front and rear covers may have holding or locking devices to fixedly, removably or hingedly hold them together during use. For example, the front cover may have a tab 10 that engages a lock 11 on the back cover to keep the front cover closed, yet provide an easy way to open the dispenser. When closed, the front cover and back cover form a structure hereafter referred to as the cover. Various other ways to lock or fix the front cover to the back cover may also be employed. For example, a lock and key approach may be desirable in commercial, industrial or institutional applications or in houses where there are small children present.

Figure 2:
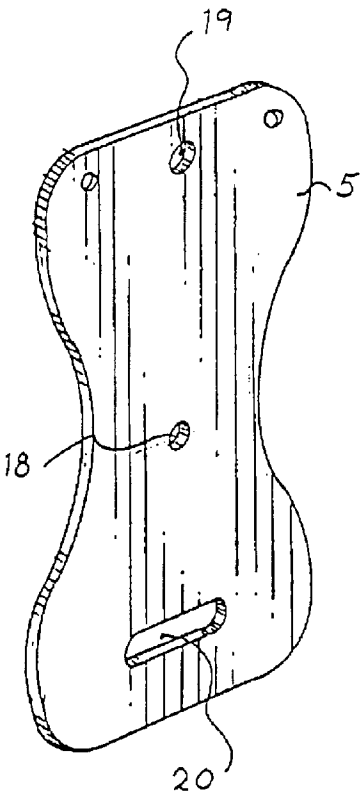
FIG. 2 is a perspective view of a back mounting piece.

The dispenser may be mounted against a wall by means of a back mounting plate 5 which can be attached to the dispenser and preferably to the back cover. The back mounting plate can be aligned with the back cover and held in place using guide tabs 12 and 13 and slots 14 and 15. The back mounting plate may be removably attached to the cover by locking tab 16 and slot 17. A threaded member or screw 9, which passes through the mounting assembly 4 and is movably connected to opening 18, may be adjusted so as to exert pressure on the back mounting plate against the wall and stabilize the rest of the dispenser. The opening 18 may be of a larger diameter than the screw, thus allowing the screw to pass through. Additionally a nut, or other type of retaining means may be employed at the end of the screw away from the tightening knob. This retaining means can prevent the screw from falling out or being lost when the dispenser is not attached to a surface or wall. A possible embodiment of a back mounting plate is shown in FIG. 2.

Figure 3:
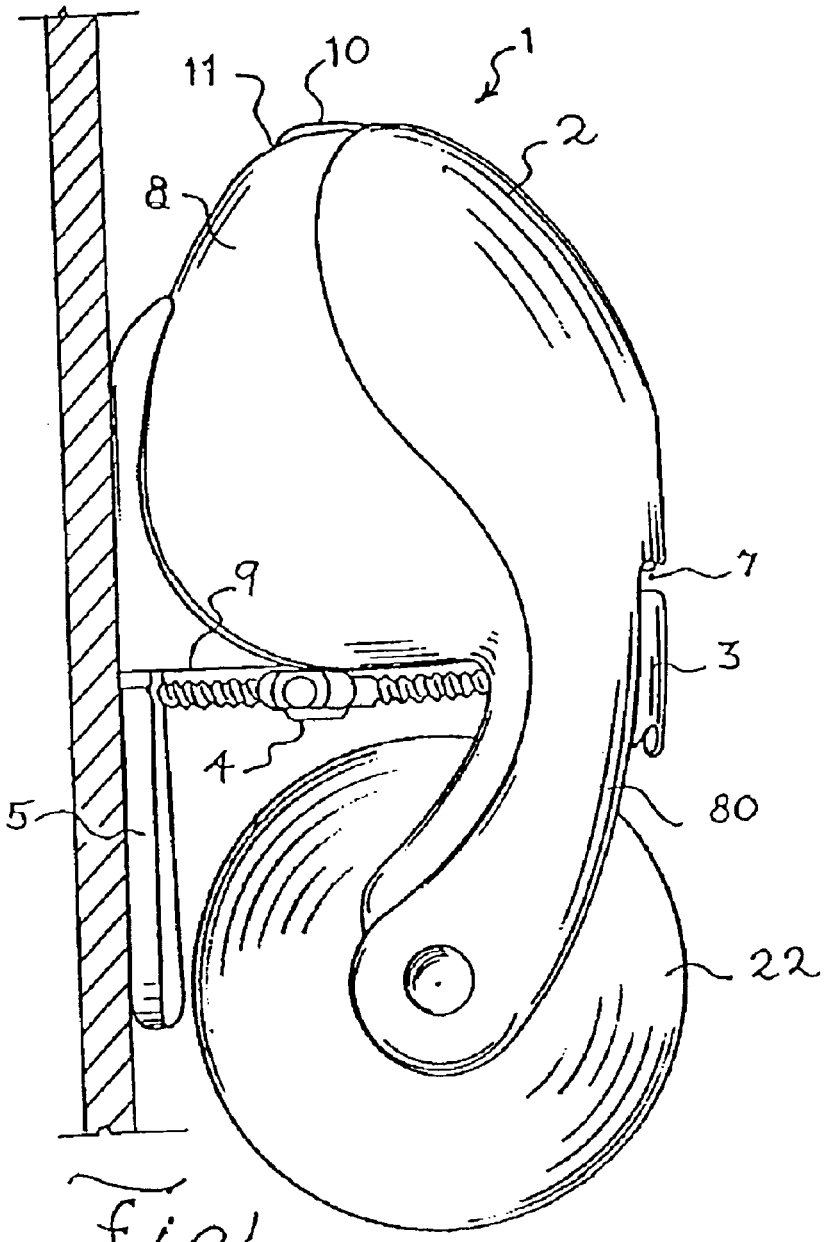
FIG. 3 is a side view of a dispenser mounted to a surface.

The dispenser may be configured as shown in FIGS. 3 and 47 to mount onto or into a conventional wall mount toilet paper holder. It may also be mounted directly to a wall, for example by way of a screw, through mounting hole 19 and/or 20, or by other means of fixing the dispenser to a wall or surface, such as glue, nails, screws, rivets, magnetic attachments, staples, engaging brackets and pressure mountings against the sides of a conventional wall mount for toilet tissues.

The dispenser and its components may independently be made from any suitable material, such as plastic, wood, ceramic, porcelain, glass, paper, metal, thermoplastic elastomers, or composite materials. For example, the following materials may be used to make the dispenser: polypropylene; polyesters such as polybutylene terephthalate (Pbt); Pbt glass filled; Pbt 15% glass filled; fiberglass;

carbon fiber; and acrylonitrile-butadiene-styrene (ABS). The cover may have different shapes and sizes. FIGS. 4 through 14 show further embodiments of dispensers that may be used with a back mounting piece to fix the dispenser to a surface. When the dispenser is intended for use in a home it is desirable that the cover be of a size that is similar to conventional bath tissue roller mounts. It is particularly desirable that the dispenser be as compact as possible for home use. Further if the cover is in the range of from about 4½ inches (114.3 mm) to 6⅞ inches (174.6 mm) in width it will be able to aesthetically fit in or mount to the vast majority of toilet paper holders that are in existing houses. Preferably the width of the cover may be greater than about 3 inches (76.2 mm), less than about 6 inches (152.4 mm), less than about 7 inches (177.8 mm), and less than about 8 inches (203.2 mm). The 4½ inches (114.3 mm) by 6⅞ inches (174.6 mm) size provides an added benefit of enabling one size of dispenser to be used in the vast majority of applications in the home, although smaller sizes may be desirable for certain applications or aesthetic reasons, such as a small bathroom. When the dispenser is used for commercial, industrial or institutional applications it may be desirable to make the cover substantially larger and able to hold substantially more rolls of either or both wet and dry wipes and tissue. It may also be desirable to incorporate a plurality of wet wipe holders. The dispenser and its components may have varied colors, such as the almonds and whites that are seen in porcelain bath fixtures or may have any other desirable color.

The front cover may be clear or have a window for viewing the amount of wet wipes that remain in the dispenser. It is noted, however, that because the front cover may be in direct contact with the wet wipe, since the cover forms a top for the cartridge when the cartridge is inserted into the dispenser and the cover closed, wood or any other material that would support bacterial growth would not be favored. It is preferred that all materials that are in contact with or associated with the wet wipes be made from materials that discourage, or do not support bacterial growth.

The cover is designed to cooperate with the cartridge 23 to form a barrier to moisture loss from the wet wipes. The cover may also be designed to cooperate with other components of the dispenser system to form a moisture barrier. The dispenser can maintain wet wipes in a moist condition when fully closed for at least 1 day, for at least 2 days, for at least 5 days and for at least 14 days, and preferably for more than 14 days at room conditions of 73° F. (22.8° C.) and 50% relative humidity. The dispenser when fully closed can maintain at least about 15%, at least about 20%, at least about 25%, at least about 50% and at least about 95% of the moisture of the wipes for a 14 day period at 73° F. (22.8° C.) and 50% relative humidity. These moisture retention values can be obtained with a tail of the wipe protruding through the gap, the tail having a length of not more than 1.5 inches (38.1 mm).

The cover may further be designed to cooperate with the cartridge, or other components of the dispenser system, to form a barrier to contamination of the wipes within the dispenser. Thus, the cover in cooperation with the cartridge, or other components of the dispenser system, may form a barrier to dirt, dust, mold spores and bacteria.

The space between the inner surface of the front cover and the surface of the lip of the cartridge may vary between about 2 mm and about 10 mm. In this way there is formed a dome above an open cartridge that at least partially covers that opening, which dome is preferably less than about 15 mm, less than about 10 mm, less than about 5 mm and ideally is less than about 2 mm above the lip of the cartridge. The height of the dome may also be measured from the surface of a full roll of wet wipes in which an additional 2 to 7 mm may be added to the height of the dome. Higher domes may also be employed, but such higher domes may be less aesthetically pleasing and may provide for greater amounts of evaporation or moisture loss from the wet wipes.

The front cover and wiper assembly 24 cooperate with the lip 25 of the cartridge. In this way when the cover is closed the inside rim is brought against the lip of the cartridge and the wiper blade is similarly brought against the tray including the guides, as well as the lip of the cartridge.

The distance between the inside of the front cover where the wiper is located and the tray may be less than the thickness of the wiper blade. Thus, in this configuration the wiper blade would be placed under compression against the lip, the tray, or the guides 26 or all of them depending on the position of the wiper. Here the wiper blade would exert pressure on the wet wipes. The wiper may also be positioned so that it contacts the wet wipe but does not exert pressure against it, or be positioned so that it is a short distance above the wet wipe. The amount of pressure that the wiper blade exerts on the wet wipe may vary depending upon several factors, including the purpose for the wiper, the material that the wiper blade is made from, the material that the wet wipe is made from and the material that the cartridge lip 25 is made from. Thus, the wiper may be configured and positioned to prevent the tail of the wipes from withdrawing, or being pulled back to the dispenser, such as for example by the weight of the roll.

The tray 3 may be made from any similar material to the cover, and it may be the same material or different material from those components. The tray may have side walls 27 and 28. The tray shown in FIGS. 5 and 7, for example, does not have bottom walls, although one may be provided if desired. The side walls may be provided with recesses 29, 30 and 31. These recess cooperate with protrusions 32, 33 and 34 on the cartridge (32 with 31, 33 with 29, and 34 with 30). In this way the cartridge is securely, yet easily removably held in the dispenser. The tray opening 35 is sized in relation to the cartridge (or the cartridge may be sized in relation to the tray opening) so that the cartridge can easily be slid into and out of the dispenser.

Figure 5:
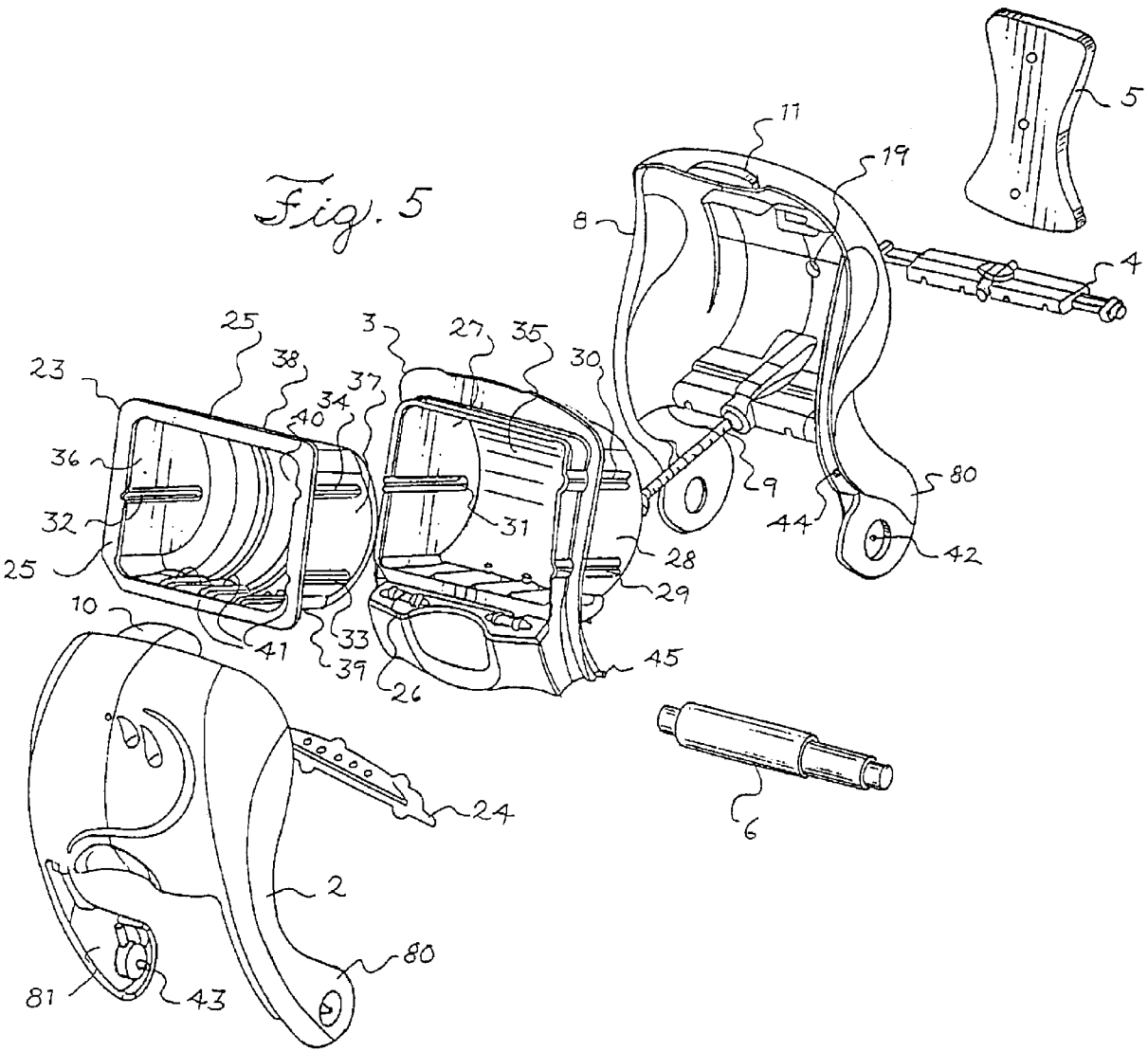
FIG. 5 is an exploded view of a dispenser, cartridge and back mounting piece.
Figure 6:
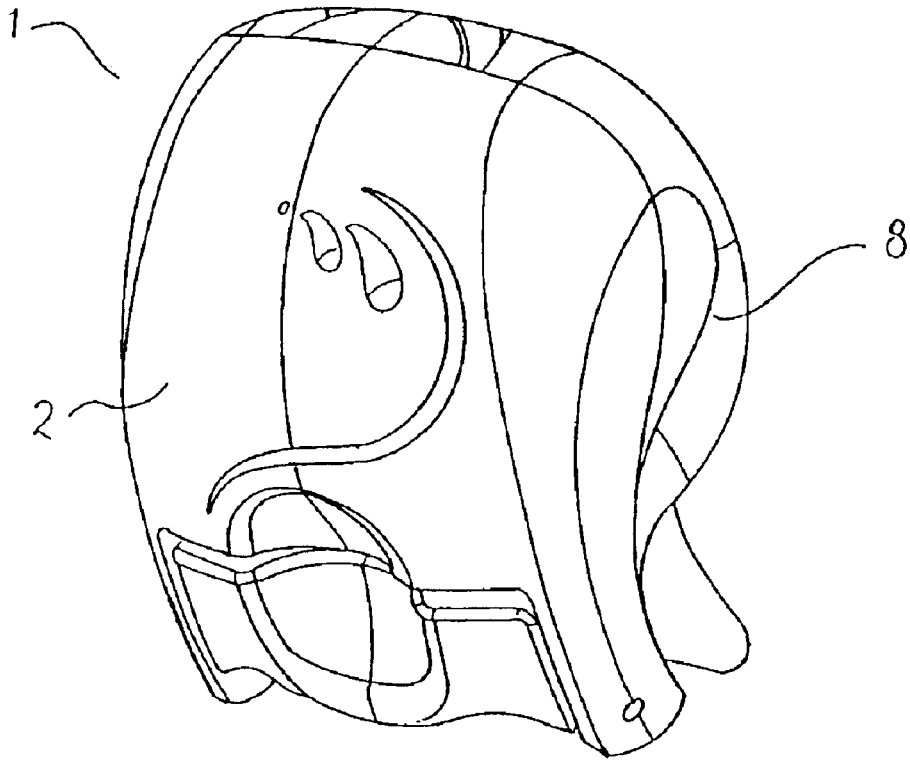
FIG. 6 is a perspective view of a dispenser and back mounting piece.
Figure 7:
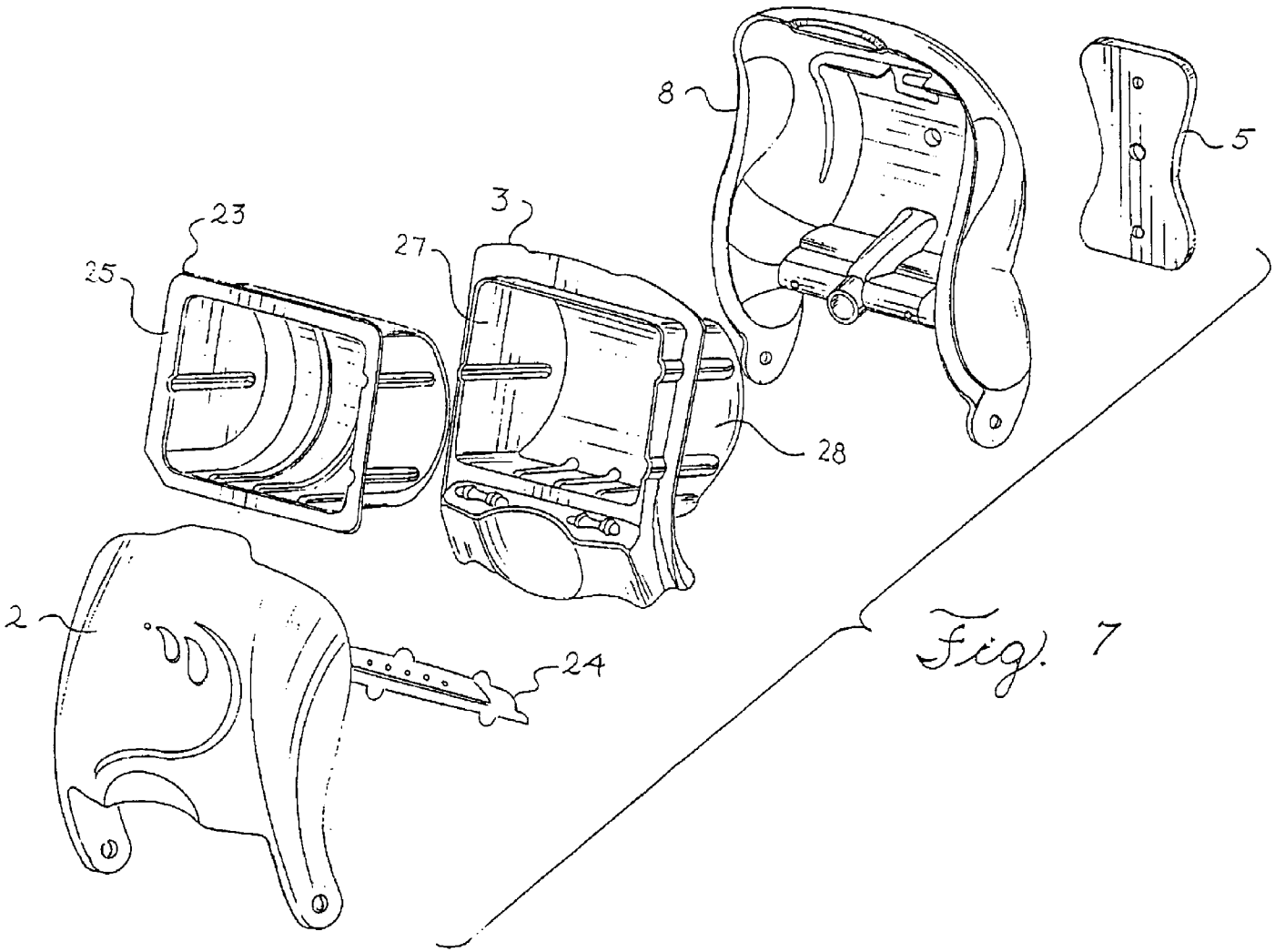
FIG. 7 is an exploded view of a dispenser, cartridge and back mounting piece.

As is apparent from FIG. 5 the tray opening and cartridge are not symmetrically shaped, i.e., they are asymmetric. The asymmetry of the tray and cartridge results in a keyed type arrangement that allows the cartridge to be inserted fully or properly in only one orientation into the dispenser. This assures that the roll of wipes will unwind from a predetermined orientation, i.e., from the bottom of the roll or the top of the roll. For example, in the embodiment shown in FIG. 5 the asymmetry in the vertical plane is obtained by having a different number and location of protrusions and recesses on opposite sides. It is recognized that any suitable means to accomplish asymmetry may be employed, such as notches, tongue and groove, the shapes of the opening and detents, the shape of the lip, the shape of the walls, and the dimensions of the cartridge walls. For example, some of the cartridge walls may be flat while others are rounded, or the cartridge lip may be non-planar. Additionally, labeling or marking of the cartridge, the tray, or both can create the effect of asymmetry.

The cartridge may be made out of any suitable material, such as plastic. It is preferable that the cartridge be made from a light weight, inexpensive, disposable and recyclable material. The cartridge has side walls 36, 37, 38 and 39 and bottom wall 40. The cartridge has a lip 25 that forms an opening in the cartridge. The cartridge has ribs 41. The ribs may extend part way or all the way along the sides 38 and 39 and the bottom 40. The ribs may cause grooves or indentations to form in the rolls, depending on the density of the roll and conditions of use. These grooves are not necessary to the use of the dispenser system.

The cartridge may be any shape or size provided that it fits in or cooperates with the dispenser. For example a cartridge that would be useful for application in the home would have side walls 36 and 37 that are less than 105 mm and side walls 38 and 39 that are less than 134 mm.

Figure 1D:
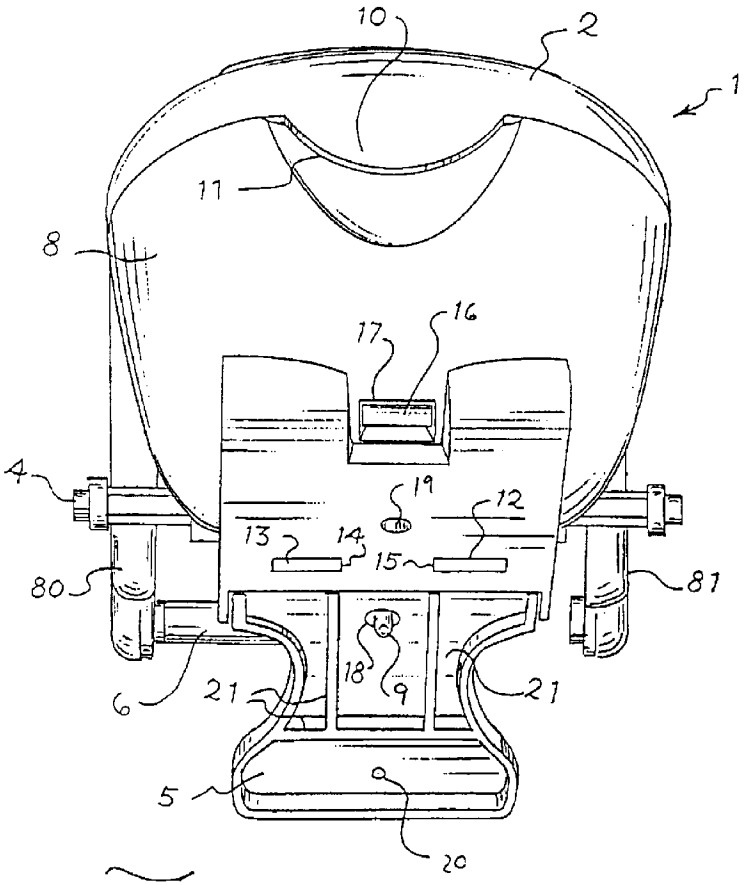
FIG. 1D is a perspective top view of a dispenser and back mounting piece.
Figure 1C:
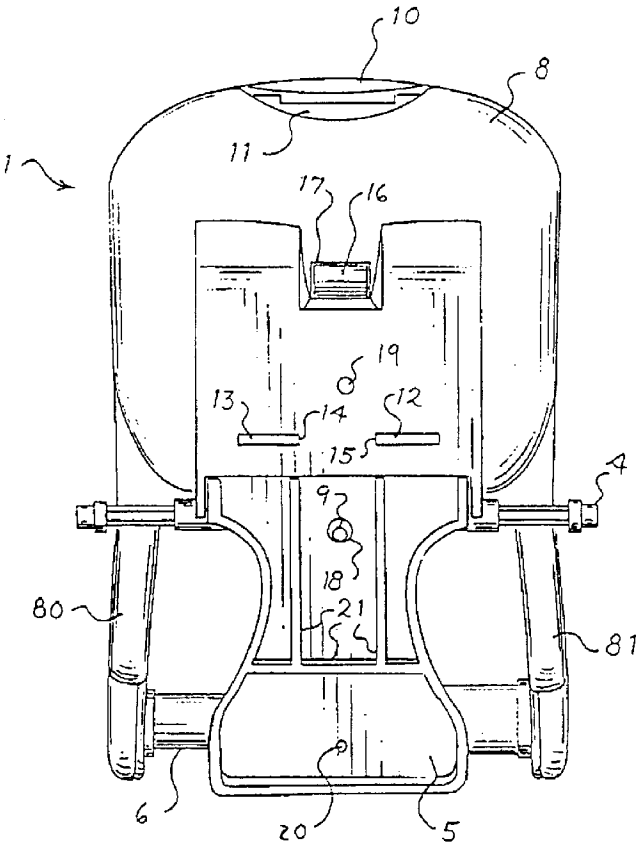
FIG. 1C is a back view of a dispenser and back mounting piece.
Figure 1F:
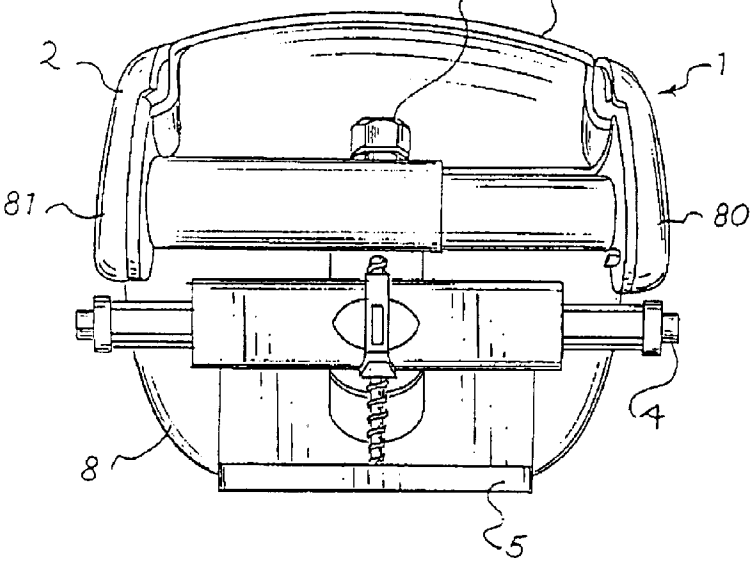
FIG. 1F is a bottom view of a dispenser and back mounting piece.
Figure 1E:
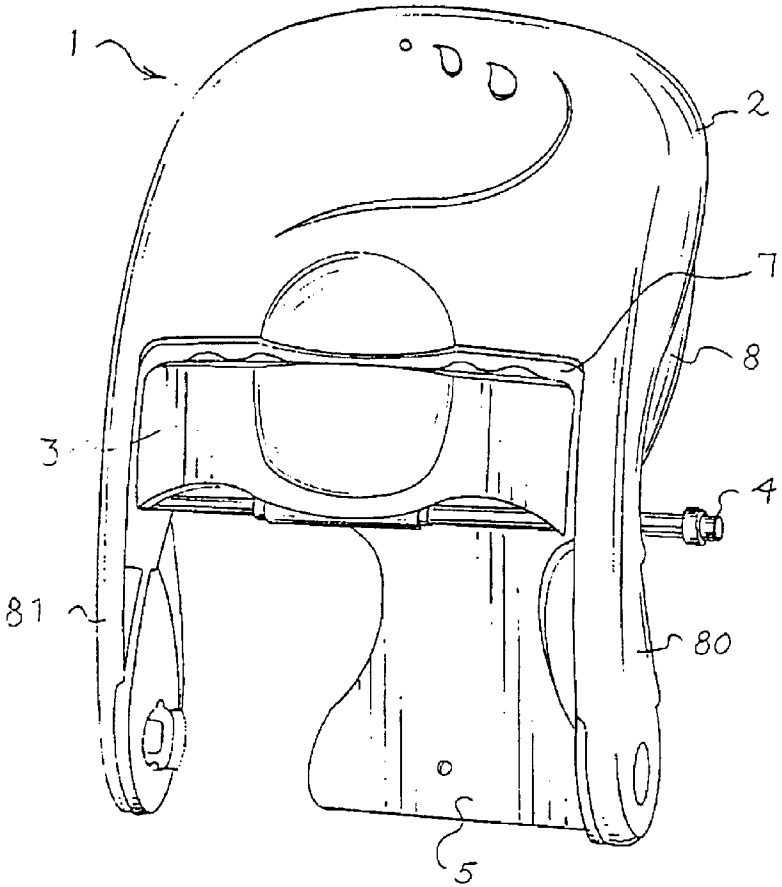
FIG. 1E is a perspective side view of a dispenser and back mounting piece.
Figure 4:
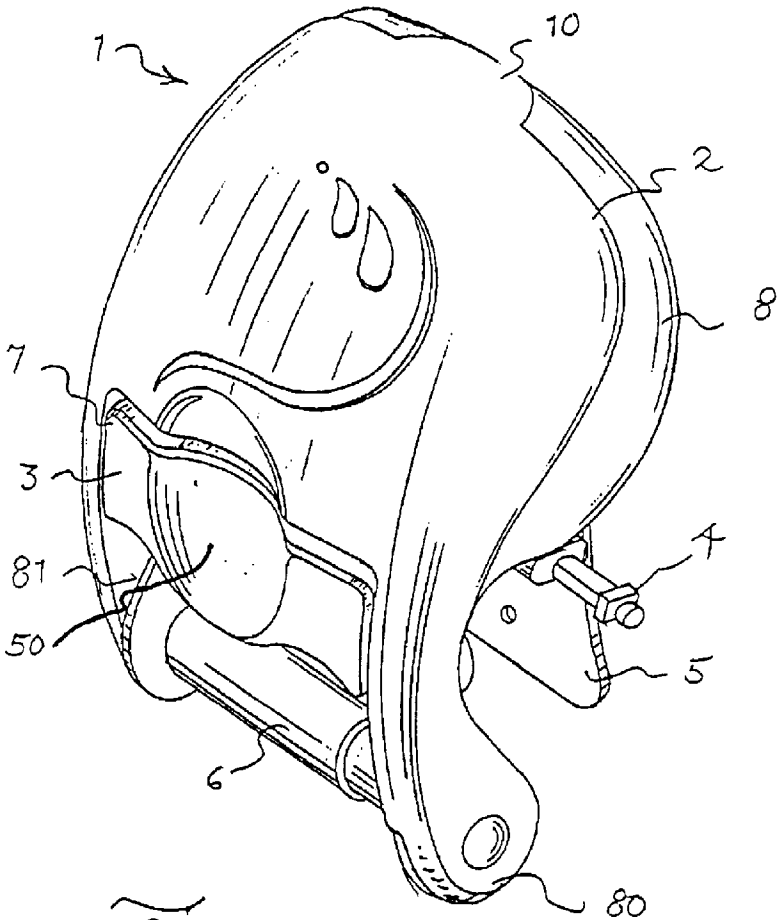
FIG. 4 is a perspective view of a dispenser and back mounting piece.

In further embodiments (see generally FIGS. 9–14) the back mounting piece may be attached to the cover via fasteners or mountings. The back mounting piece may be attached to a tongue piece 51, or the tongue piece could be attached to the cover. The tongue piece may be molded into either the cover or the back mounting piece, or the cover, tongue, and back mounting piece may be molded into a single object. The tongue piece may have a monorail slot 48. The mounting assembly may have a protrusion 49 that fits into the monorail slot like a key, such that the mounting assembly is movably connected to the tongue piece. The back mounting piece may lock to the rear cover by connecting tabs on the back mounting piece with slots on the rear cover. The back mounting piece may further have reinforcing ribs 21; such ribs are also illustrated in FIGS. 1C and 1D.

In general the dispenser system illustrated herein can be used with or without conventional dry toilet or bath tissue. If conventional tissue is used with wet wipes it could be positioned in a side-by-side manner, above, below, behind or in front of the wet wipes.

Figure 8:
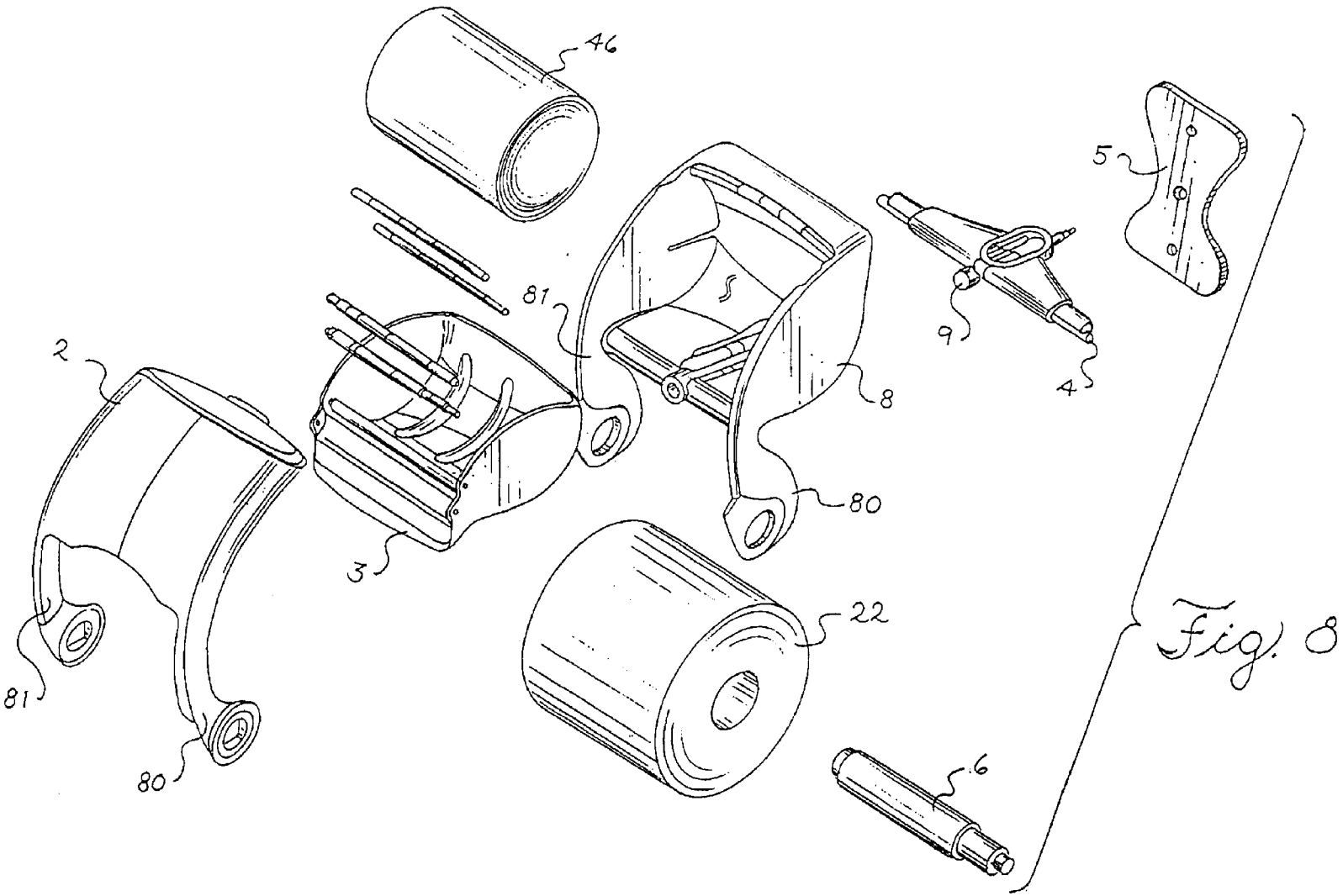
FIG. 8 is an exploded view of a dispenser and back mounting piece.
Figure 10:
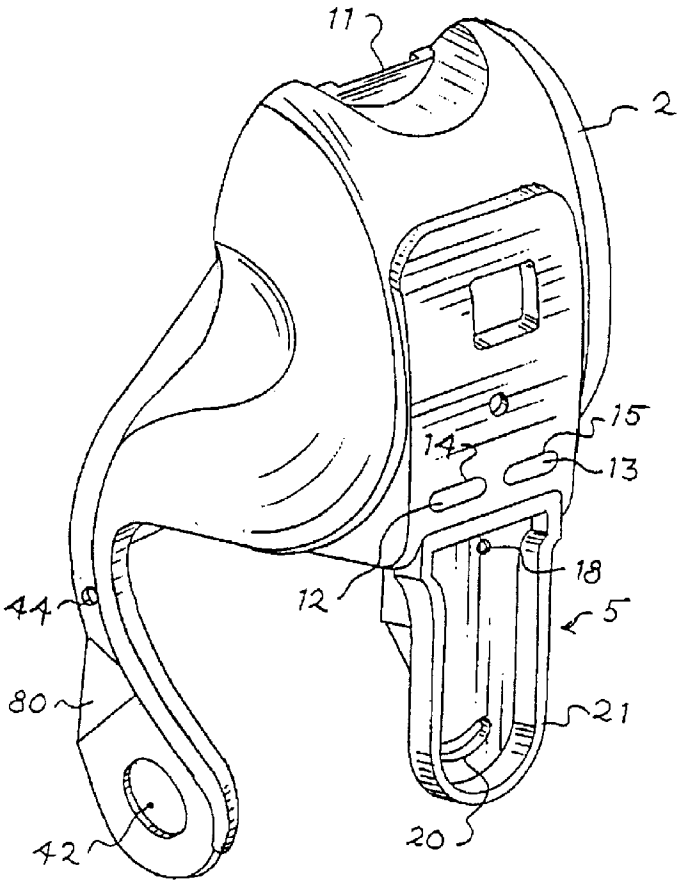
FIG. 10 is a perspective rear view of a dispenser and back mounting piece.
Figure 9:
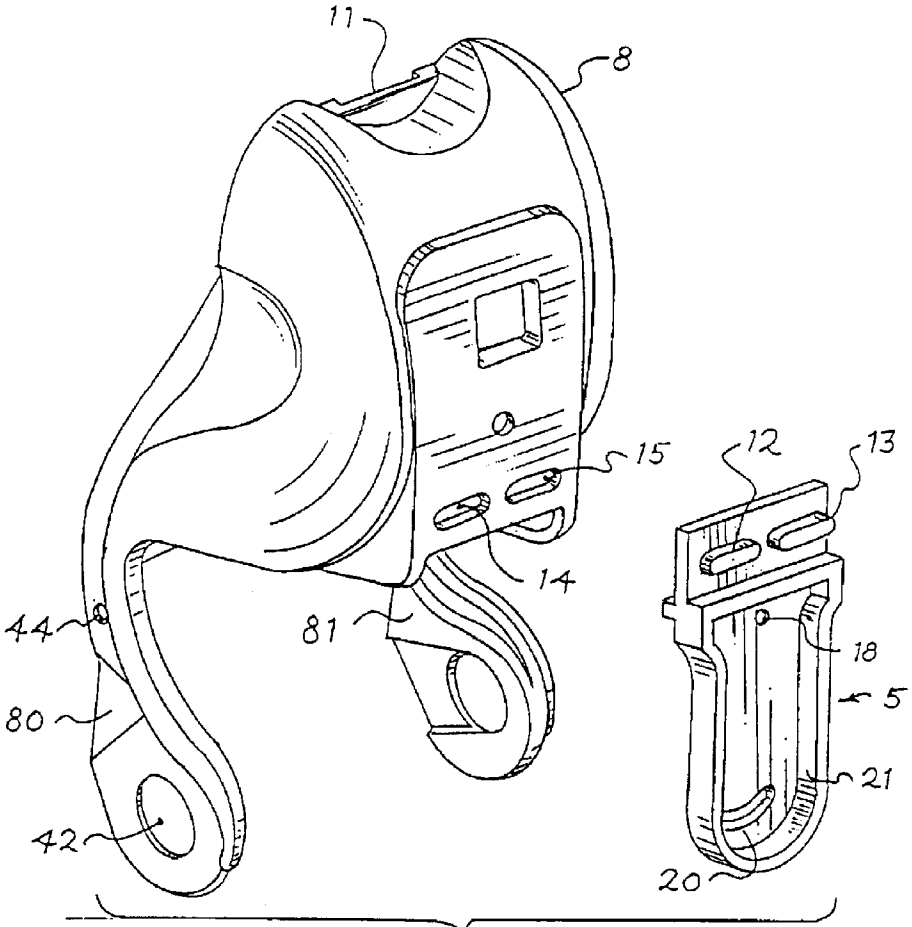
FIG. 9 is an exploded view of a dispenser and back mounting piece.
Figure 14:
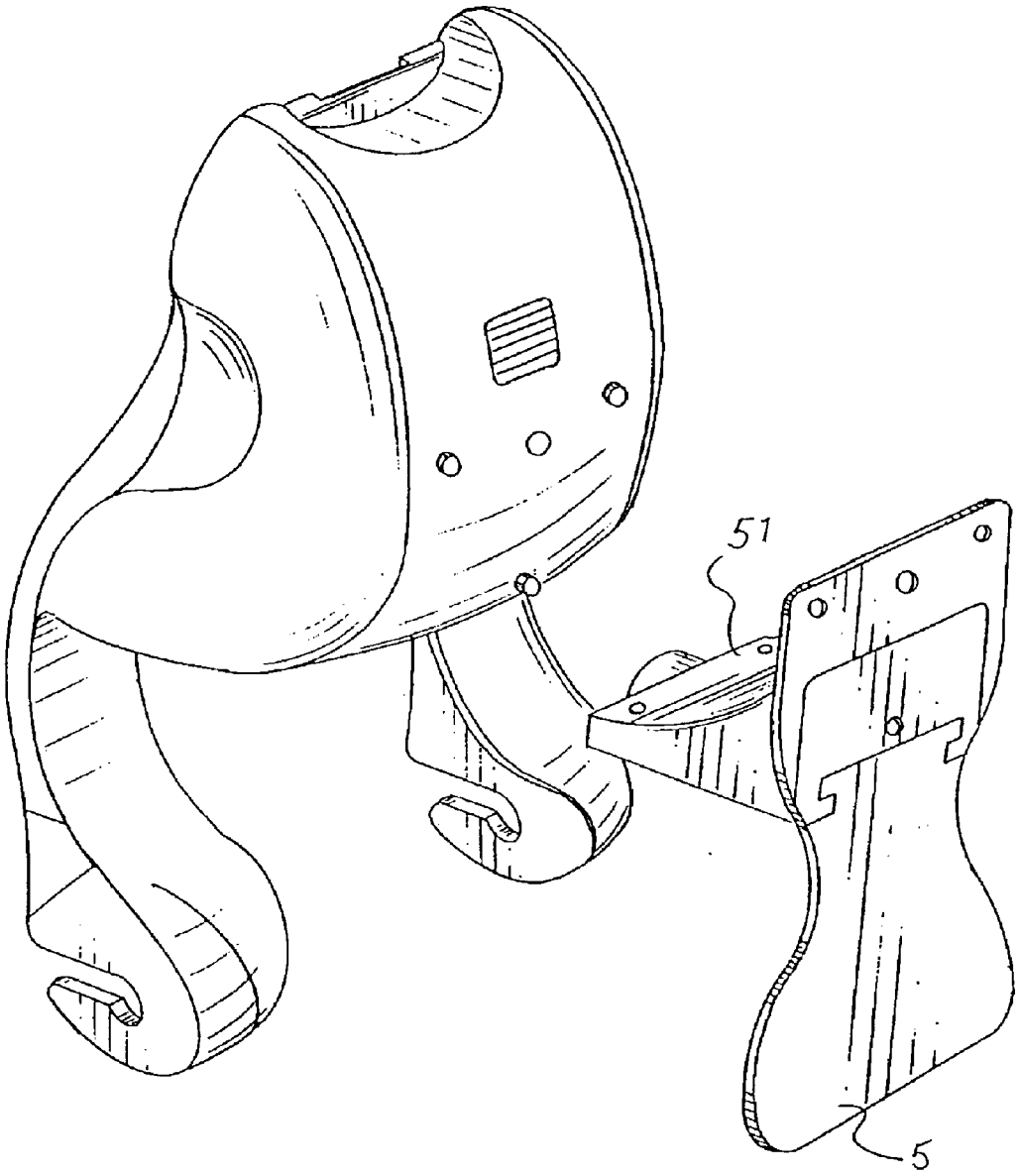
FIG. 14 is an exploded view of a dispenser and back mounting piece.

Referring to FIG. 5, the cover may also have an opening 42 that is made to receive cover mounts 43. The opening 42 and the cover mounts 43 may further be configured to receive a conventional toilet tissue roller. The cover may further have an opening 44 for receiving a pin 45 on the tray 3. An embodiment without the cover mount 43 is shown in FIG. 9. In a further embodiment, shown in FIGS. 11, 13, and 13A the cover may have an opening 47 for receiving a spindle 120, with a cap 121, which is not spring loaded and can receive a conventional toilet tissue roll 22 (FIG. 8).

FIGS. 15 through 18 show an example of a mounting assembly. This mounting assembly comprises slide arms 52 and 53, housings 54 and 55, end openings 56, and springs 57. The slide arms have stops 58 that cooperate with stops 59 to limit the maximum longitudinal extension of the slide arms. The mounting assembly has a third housing 60 that has tabs 61 that cooperate with openings 62 to secure the housings 54 and 55 to housing 60. Housing 60 further has a threaded passage 63 for receipt of a screw. FIG. 17 shows the mounting assembly with the slide arms in a retracted position, while FIG. 18 shows the mounting assembly with the slide arms in an extended position. In one embodiment, the length of the mounting assembly in the retracted position is about 3.5 inches (88.9 mm), and the length of the mounting assembly in the extended position the length is about 8 inches (203.2 mm). Preferably the length of the mounting assembly in the retracted position is about 5 inches (127.0 mm), and the length of the mounting assembly in the extended position the length is about 6.5 inches (165.1 mm). The three housing design may also be simplified into a two housing embodiment or a single housing embodiment. In the two housing embodiment, top and bottom or side and side halves are fixed together to hold the spring and slide arms.

The assembly is held in place by having the ends of the slide arms positioned in holes in the object to which the dispenser is to be attached, for example, the holes in a toilet paper dispenser mounted into a wall as shown in FIG. 47. The springs keep the slide arms extended and thus hold them in the holes. A screw is then inserted through the dispenser and the passage 63 and tightened down, forcing the end engagement surfaces 64 against the wall of the holes in the toilet tissue dispenser.

The mounting assembly should be made out of material that is strong enough to withstand the forces that are placed on it to hold the dispenser in place. It should also have enough strength to withstand the forces that the screw will place on the threaded passage. Examples of materials that may provide these features and be used to make the mounting assembly are 15% or more glass filled Pbt, ABS or any material having similar strength to properties.

Figure 15:
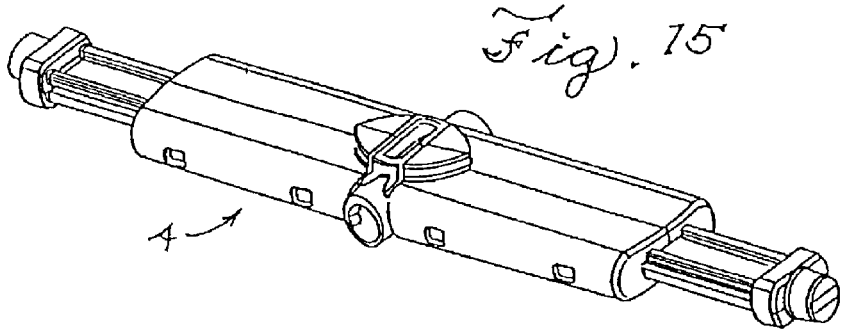
Figure 16:
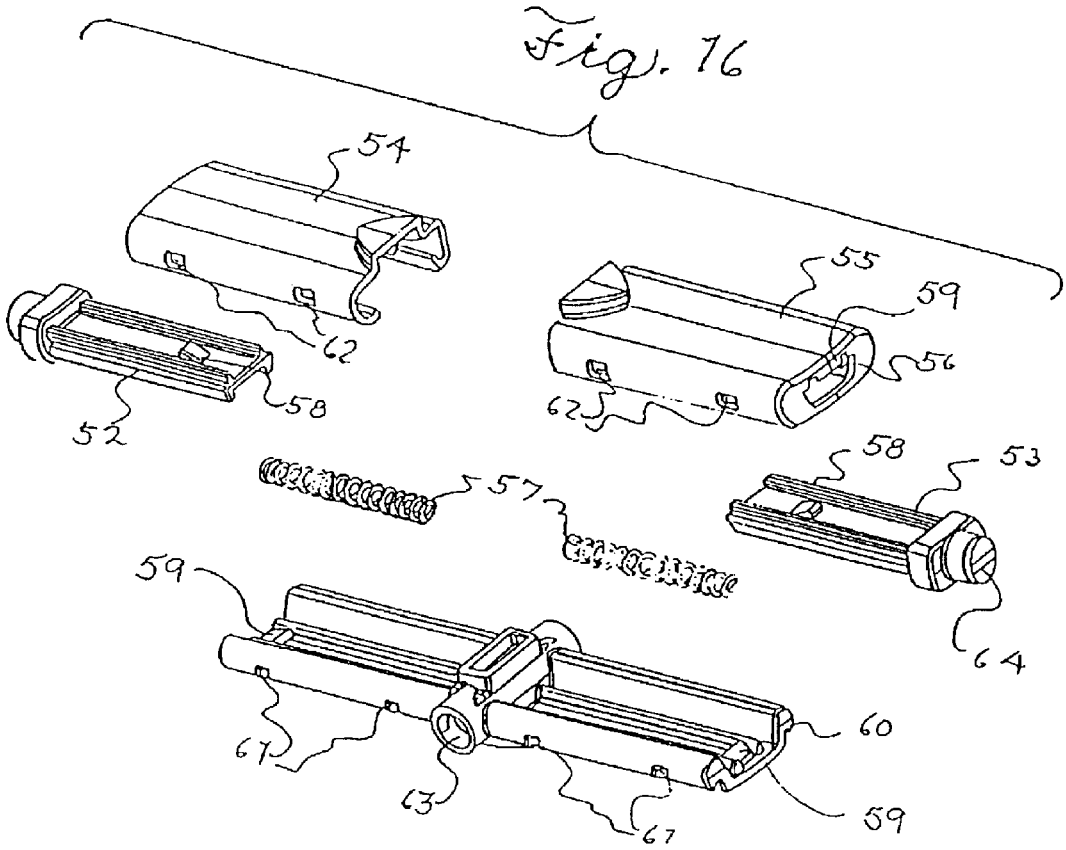
Figure 29:
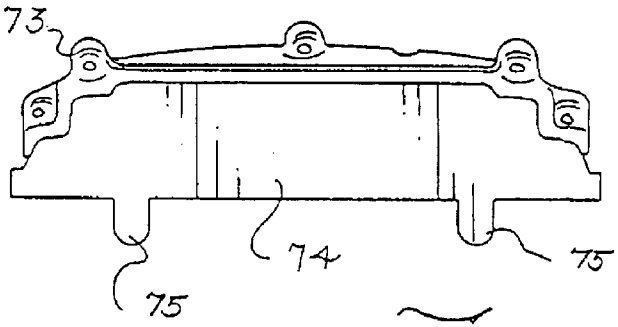
FIGS. 28–33 are views of a wiper blade assembly.
Figure 33:
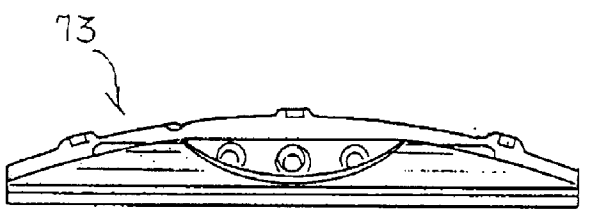
Figure 28:
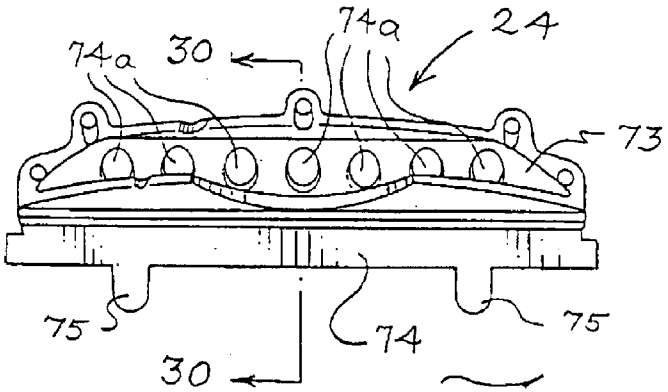
Figure 31:
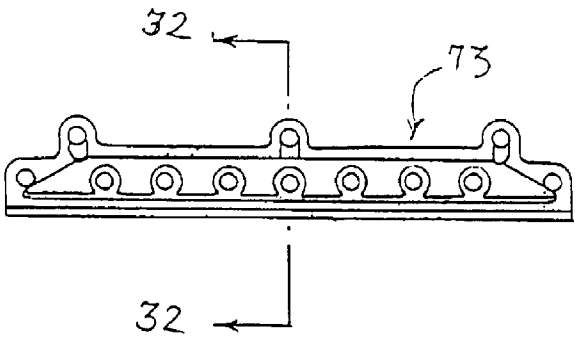
Figure 30:
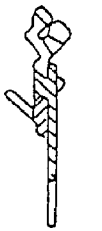
Figure 32:
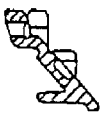

FIGS. 19 to 23 show an example of a screw 9 that cooperates with a mounting device, such as the example shown in FIGS. 15 to 16. The screw should be made of material that meets the same strength requirements as set out for the mounting assembly. In this example the screw has a thread design that requires 6 turns to move it 1 inch (25.4 mm). Standard ACME conventional screw threads require 23 turns to move it 1 inch (25.4 mm). This thread design provides greater ease for the user to attach the dispenser because it requires less turns of the screw to do so. In this example the screw additionally has a large head, with a groove 65 and grips 66. The groove can fit a coin or screwdriver. The screw head, however, need not have a large head or a groove. The screw may further be provided with a lock nut or jam nut near the head of the screw to prevent loosening of the screw after it is tightened.

Alternative mountings may also be employed. These mountings may be fixed or removable. They may include by way of example such fastening systems as cable ties, wing nuts, anchor bolts, click and grooves and snap and lock mechanisms.

FIG. 24 shows a roll of wipes 46 that has a tail 67 and further defines the axis of the roll as 68. In use the tail of the wet wipe would be grasped and pulled generally in the direction of arrow 69 causing the roll to unwind and the wipe to be dispensed from the dispenser. In use the wet wipe may also be subjected to forces tangential and perpendicular to the direction of arrow 69. If these forces occur the guides and the wipers help to prevent the wipe from skating to one side of the gap and bunching up or binding.

Rolls useful with this dispenser or as part of a dispensing system may contain from as little as a few linear inches (or cm) to more than 450 linear inches (11.43 m), to more than linear 600 inches (15.24 m) to more than a thousand linear inches (25.40 m) of wet wipes. The rolls may have a web of material that may have any number of sheets. Usually, the sheets are separated by perforations that enable the sheet to be easily torn from the web but are strong enough that they will not separate while the web is being pulled from the dispenser. An example of a roll that is particularly useful for applications in the home is one that has a diameter of about 2 inches (50.8 mm) to about 3 inches (76.2 mm), of about less than 5½ inches (139.7 mm), and preferably has a diameter of about 3 inches (76.2 mm) and more preferably of about 2⅞ inches (73.0 mm). This roll has from about 400 linear inches (10.16 m) of wipes to about 1000 linear inches (25.40 m) of wipes. Without limitation, each sheet length may be from about 3 inches (76.2 mm) to about 10 inches (254.0 mm) and preferably are about 4.5 inches (114.3 mm). This roll may further have a density of from about 0.3 g/cc to about 1 g/cc, from about 0.5 g/cc to about 1 g/cc and preferably about 0.62 g/cc. A particular example of a roll may be one having a diameter of about 2 inches (50.8 mm) and containing about 450 linear inches (11.43 m) of wipe. Another particular example of a roll may be one having a diameter of about 3 inches (76.2 mm) and containing 450 linear inches (11.43 m) of wipes.

The preferred form of wet wipes for use with the dispenser system is a solid coreless roll as shown in FIG. 24. It is to be understood, however, that cored rolls (hollow cores, solid cores and partially solid cores), hollow careless rolls, and stacks of sheets may also be used in the dispenser system. When density values are referred to herein, it is for the density of the roll and this would exclude any void, for a coreless hollow roll, or space occupied by a core for a cored roll.

Various tests and observations of physical properties are reported in Tables I, II, III, and IV.

Solution add-on level is the amount of solution by weight divided by the amount of dry wipe by weight multiplied by 100 to provide a percentage value.

Base sheet converting refers to the width of the roll and the sheets in the roll, i.e., along axis 68 of the roll in inches.

Perforation refers to the amount of cutting and the distance between the cuts in the perforation that separates the sheets in a roll. There are three parameters to this measurement: cut length, bond length and bond spacing. The bond spacing is equal to the sum of the cut length plus the bond length. By way of example, perforations that are useful with wet wipes are ones that have a bond length of 0.02 inch (0.51 mm), a cut length of 0.05 inch (1.27 mm), and a bond spacing of 0.07 inch (1.78 mm), or one that has a bond length of 0.04 inch (1.02 mm), a cut length of 0.09 inch (2.29 mm) and a bond spacing of 0.13 inch (3.30 mm).

Dry basis weight is the basis weight of the wipe before the solution is added to the wipe, i.e., before it is wet.

Wet thickness is the thickness of a wet wipe, i.e., after the solution has been added to it, in mm.

Sheet count is the number of sheets in a roll, i.e., the number of sheets created by the perforations.

Although all tests are done under TAPPI standard test conditions, the wet wipes are not equilibrated to those conditions. Instead, the wipes are removed from a sealed container or cartridge and tested within a few, generally less than 5–10, minutes after opening. This is about a 5 minute variation in this time period that the wet wipe is exposed to the atmosphere, which does not materially or significantly alter the test results.

Tensile, stretch and TEA (total energy absorbed) values were obtained on the wet product following ASTM 1117-80, section 7, with the following modifications: sample dimensions were 1+/−0.04 inch (25.4+/−1.0 mm) wide and 4.25+/−0.04 inches (108.0+/−1.0 mm) wide; initial gauge length was 3 +/−0.04 inches (76.2+/−1.0 mm); test speed is 12 inches/minute (305.0 mm/min).

MD tensile is the peak load before failure per inch width of the sample, as determined in the machine direction. CD tensile is the peak load before failure per inch width of the sample, as determined in the cross direction. MD stretch is the percentage of elongation the wipe has in the machine direction at the peak load. CD stretch is the percentage of elongation of the wipe in the cross machine direction at the peak load. Total Energy Absorbed (TEA) is the area under the force-elongation curve (in units of lb. and ft., respectively) from the start to the failure point divided by the initial surface area of the sample between the upper and lower grips. For these samples, this surface area was 3 sq. inches (19.4 $cm^2$). Ten specimens were tested for each code, and the average was calculated and reported. The test can be carried out on a standard tensile tester such as a MTS Sintech 1/G test machine with TestWorks 3.10 software. Both the Sintech test machine and the TestWorks software are available from MTS Corporation located at 1400 Technology Drive, Eden Prairie, Minn.

Detach refers to the force in grams per sheet that is required to break a perforation, i.e., the amount of force required to separate two sheets in a roll along the perforation. These properties were determined using a MTS Sintech 1/G test machine with TestWorks 3.10 software. Two sheets were removed from a roll. The sheets had a width of 4.25 inches (108.0 mm), and were connected by perforations along the width. The sheets were folded in half along the length such that the width of the sample was 2⅛ inches (54.0 mm). The top and bottom of the sample were placed in grips-having an internal spacing of 2 inches (50.8 mm), such that the perforation line was centered between the upper and lower grips. The upper grip was then displaced upward (i.e. away from the lower grip) at a rate of 10 inches/minute (254.0 mm/min) until the sample was broken along the perforations. The applied force and sample elongation were measured throughout the test. The peak load from the force-elongation curve is recorded so that the detach strength is expressed in units of grams/sheet. The average results from ten samples are reported.

Percentage strain at peak load ("% strain @ pk load") was determined from the results of the test described above. The elongation at the peak load is divided by the initial sample length of 2 inches (50.8 mm), and the result is designated the % strain @ peak load. The average results from ten samples are reported.

Wet thickness refers to the thickness of a wipe that is measured while the sample is subjected to a specified load or weight. The wet thickness of wet wipes and wipes before wetting are reported in Table II. These values are based on samples measuring 3×4 inches (76×102 mm) that were individually placed under a confining load of 0.05 pounds/square inch (psi) (345 Pa). The region of the sample that was tested was free of wrinkles and folds. A Starrett Comparator Base Model 653G was used to perform these tests available from Starrett, 121 Crescent St., Athol, Mass. 01331. This base is precision ground to be flat (tolerance of +/−0.001 inch, +/−0.025 mm). A digital displacement indicator (Sony model U30-1SET) was attached to the base via a cantilevered horizontal control arm supported by a vertical shaft. The indicator measures vertical displacement relative to the comparator base to within 0.001 inch (0.025 mm). The load was applied by an acrylic contact foot attached to a vertically traveling spindle shaft that descended to the comparator base. The foot has a diameter of 3.00 inches (76.2 mm), a height of 0.63 inch (16.0 mm) and is flat on the lower surface to a tolerance of +/−0.001 inch (0.025 mm). The weight of the contact foot, spindle, and the associated hardware, not including the contact force springs in the indicator, is 160.5+/−0.1 g. The spindle shaft descends to the comparator base with a travel time of 0.5 seconds to 0.75 seconds. The thickness was measured by the indicator as the height of the wipe relative to the surface of the comparator base immediately after the load pressure of 0.05 psi (345 Pa) was applied for 3 seconds. Calibration before testing was performed on a set of standard samples traceable to the National Bureau of Standards.

By way of example and without limitation, wet wipes useful in the present dispensing system may have a dry basis weight from about 10 to about 200 gsm, a dry thickness from about 0.5 to about 2 mm, a wet (i.e., wipe with solution or wetting material added) thickness from about 0.3 to about 0.7 mm, a MD wet tensile at least about 250 g/inch (9.8 g/mm), a CD wet tensile at least about 200 g/inch (7.9 g/mm), a MD wet stretch from about 5% to about 30%, a CD wet stretch from about 5% to about 36%, a TEA MD wet strength of from about 0.5 to 2 ft-lb/sq. inch (0.10 to 0.4 $J/cm^2$), a TEA CD wet strength of from about 0.5 to 2 ft-lb/sq. inch (0.10 to 0.4 $J/cm^2$), and a solution add-on of about 150–350%.

Peel force measures the amount of force in grams/4.25 inches (g/108.0 mm) required to unroll a roll of wet wipes, i.e., the grams required to unroll a roll that is 4.25 inches (108.0 mm) wide. Thus, these values could be normalized to apply to any width roll in grams/inch of roll width basis. The peel force, as reported in Table II was the force required to unroll a roll as it was resting in an open cartridge and was measured with an MTS Sintech 1/G test machine with TestWorks 3.10 software. A 4.5-inch (114.3 mm) wide clamp with rubber surfaces gripped the tail of a roll, with the roll positioned directly underneath the clamp such that the tail would remain vertical as it was unwound from the roll. The clamp was attached to the crosshead, which pulled the tissue web upward at a speed of 100 cm/minute. Peel force was measured by a 50 Newton load cell. The average load to pull 18 to 20 sheets away from the roll was recorded by averaging two runs in which 4 sheets each were separated and two runs in which 5 sheets each were separated. Only the first 18 to 20 sheets from the roll were used to obtain the measurements of Table II.

The dispensing force, which is the force to pull the wet wipes from the dispenser, may also be determined. This force can be measured with a MTS Sintech 1/G test machine equipped with TestWorks 3.10 software. A clamp with rubber surfaces grips the tail of a roll of wet wipes placed in a dispenser. The initial distance between the clamp and the platform where the dispenser sits is about 12 inches (304.8 mm). The dispenser is placed underneath the clamp. The clamp is attached to the crosshead, which pulls the roll upward at a speed of 100 cm/min. The pull force is measured by a 50 Newton load cell. For each run, the pull force as a function of pull distance curve for pulling 4 sheets away from a roll is recorded using the TestWorks 3.10 software. Based on the curve, the average pull force for each run is calculated. The average load of five runs is used to represent the dispensing force of a given roll. Only the first 23 to 25 sheets from the roll were used to obtain the measurement.

Table I sets out types of wet sheets and their properties. In Example 1, the solution was a sufficient amount of commercial (no salt) solution such as that which is used in the commercially available KLEENEX® brand COTTONELLE® flushable moist wipes product of Kimberly-Clark Corporation. In Example 2, the solution was a sufficient amount of 4% salt water solution such as a simple 4% salt water solution with other additives as disclosed in the examples of wet wipe applications discussed previously in the Background of Invention, all of which have been and are incorporated herein by reference.

TABLE I

| | Non-Dispersible Wet Wipe Example 1 | | Dispersible Wet Wipe Example 2 | |
|---|---|---|---|---|
| Basis Weight | 60 gsm | | 60 gsm | |
| Solution | commercial (no salt) | | 4% salt solution | |
| Solution Add on level | 175% | | 228% | |
| Basesheet Converting | 4.25" width | | 4.25" width | |
| Perforation Bond Spacing | 0.11" | | 0.07" | |
| | Run Average | Run STDev | Run Average | Run STDev |
| Dry Basis Weight (gsm) | 57 | 2 | 66 | 4 |
| Wet Thickness (mm) | 0.56 | 0.02 | 0.47 | 0.01 |
| Sheet Count | 99 | 0.7 | 99 | 1.1 |
| Wet tensiles | | | | |
| MD Tensile (g/in) | 380 | 26 | 321 | 30 |
| MD Stretch (% Elongation) | 23 | 1.4 | 28 | 1.6 |
| TEA (Ft-Lb/Sq.In) | 0.96 | 0.06 | 1.02 | 0.07 |
| CD Tensile (g/In) | 329 | 28 | 287 | 29 |
| CD Stretch (% Elongation) | 28 | 1.8 | 34 | 3.5 |
| TEA (Ft-Lb/Sq.In) | 0.93 | 0.09 | 0.97 | 0.13 |
| Detach (g/sheet) | 752 | 21 | 853 | 34 |
| % strain @ pk load | 8 | 0.5 | 11 | 1.1 |

Table II contains additional data reflecting the properties of disposable wet wipes. This table shows the effects that changing base sheet and solution variables has on the physical properties of the wipes. The pulp used to make these sheets was Weyerhauser CF 405. For this example, the binder was example Code E, Table 15, of Ser. No. 09/564,531. This binder material had a molecular weight of 610,000 and was made from the following monomers provided in the following weight percents: 60% acrylic acid, 24.5% butacrylic acid, 10.5% 2-ethylhexyl-acrylic acid, and 5% AMPS (2-acrylamido-2-methyl-1-propanesulfonic acid).

TABLE II

| Basesheet Variables | 100% pulp/ 65 gsm 22% binder/ 1.1 mm dry thickness | 100% pulp/ 60 gsm 20% binder/ .76 mm dry thickness | 100% pulp/ 55 gsm 20% binder/ .76 mm dry thickness | 15% PET/ 55 gsm 20% binder/ .84 mm dry thickness |
|---|---|---|---|---|
| | 0.5% silicone; 0.25 lanolin | | | |
| Solutions | Example 3 | Example 4 | Example 5 | Example 6 |
| MD Wet Tensile (g/1") | 500 | 452 | 383 | 391 |
| CD Wet Tensile (g/1") | 445 | 403 | 344 | 310 |
| wet thickness (mm) | 0.46 | 0.40 | 0.39 | 0.41 |
| peel force | 167 | 131 | 106 | |
| | 1.0% silicone; 0.25% lanolin | | | |
| Solutions | Example 7 | | Example 8 | Example 9 |
| MD Wet Tensile (g/1") | 473 | | 401 | 416 |
| CD Wet Tensile (g/1") | 455 | | 348 | 350 |
| wet thickness (mm) | 0.45 | | 0.40 | 0.39 |
| peel force | 170 | | 120 | 115 |
| | 1.0% silicone; 0.0% lanolin | | | |
| Solutions | Example 10 | | | |
| MD Wet Tensile (g/1") | 528 | | | |
| CD Wet Tensile (g/1") | 462 | | | |
| wet thickness (mm) | 0.44 | | | |
| peel force | 162 | | | |

Table III sets out the physical properties of rolls of wet wipes and Table IV sets out the theoretical physical properties of rolls of wet wipes.

TABLE III

Coreless Roll Measurements and Calculations

| Roll Number | Measured Diameter (inches) | Unwound Wet Thickness (mm) | Calculated Roll Density (g/cm$^3$) | Calculated Effective Thickness (mm) | Compression Factor (%) |
|---|---|---|---|---|---|
| 1 | 2.77 | NA | 0.621 | 0.340 | 71% |
| 2 | 2.83 | 0.41 | 0.595 | 0.355 | 74% |
| 3 | 2.86 | NA | 0.583 | 0.362 | 76% |
| 4 | 2.90 | NA | 0.567 | 0.373 | 78% |
| 5 | 2.96 | 0.478 | 0.544 | 0.388 | 81% |
| 6 | 2.86 | NA | 0.583 | 0.362 | 76% |
| 7 | 2.98 | NA | 0.537 | 0.393 | 82% |

TABLE III-continued

Coreless Roll Measurements and Calculations

| Roll Number | Measured Diameter (inches) | Unwound Wet Thickness (mm) | Calculated Roll Density (g/cm$^3$) | Calculated Effective Thickness (mm) | Compression Factor (%) |
|---|---|---|---|---|---|
| 8 | 2.88 | NA | 0.575 | 0.368 | 77% |
| 9 | 2.94 | NA | 0.552 | 0.383 | 80% |
| 10 | 2.86 | 0.448 | 0.583 | 0.362 | 76% |
| 11 | 2.86 | NA | 0.583 | 0.362 | 76% |
| 12 | 2.84 | NA | 0.591 | 0.357 | 74% |
| 13 | 3.00 | NA | 0.530 | 0.399 | 83% |
| 14 | 2.86 | NA | 0.583 | 0.362 | 76% |
| 15 | 2.86 | NA | 0.583 | 0.362 | 76% |

Inital sheet length=5 inches

Inital sheet width=4.125 inches

Number of sheets in roll=90

Dry basesheets basis weight=65 gsm

Target solution add-on=225%

Calculated roll weight=253 grams

Assumed wet thickness prior to winding=0.48 mm

Compression factor=calculated effective thickness (wound)/assumed wet thickness prior to winding Calculated Roll Density=weight/$\pi d^2/4\times$width (calculated roll weight/$\pi\cdot$measured diameter$^2$/4$\cdot$initial sheet width)

Calculated Effective Thickness—calculated thickness of sheet in roll under pressure of winding.

TABLE IV

Theoretical Roll Density Possibilities

| Dry Basesheet Weight (gsm) | Solution Add-on (%) | Calculated Roll Weight (grams) | Assumed Pre-wound Wet Thickness (mm) | Assumed Compression Factor (%) | Calculated Roll Diameter (inches) | Calculated Roll Density (g/cm^3) | Footnote |
|---|---|---|---|---|---|---|---|
| 65 | 225 | 253 | 0.48 | 1.300 | 3.75 | 0.34 | (1) |
| 65 | 225 | 253 | 0.48 | 1.150 | 3.53 | 0.38 | |
| 65 | 225 | 253 | 0.48 | 1.000 | 3.29 | 0.44 | (2) |
| 65 | 225 | 253 | 0.48 | 0.900 | 3.12 | 0.49 | |
| 65 | 225 | 253 | 0.48 | 0.800 | 2.94 | 0.55 | |
| 65 | 225 | 253 | 0.48 | 0.710 | 2.77 | 0.62 | (3) |
| 65 | 225 | 253 | 0.48 | 0.600 | 2.55 | 0.73 | |
| 65 | 225 | 253 | 0.48 | 0.500 | 2.33 | 0.88 | (4) |
| 65 | 225 | 253 | 0.48 | 0.440 | 2.18 | 1.00 | |
| 65 | 225 | 253 | 0.48 | 0.405 | 2.09 | 1.09 | (5) |
| 65 | 300 | 311 | 0.48 | 1.300 | 3.75 | 0.42 | |
| 65 | 300 | 311 | 0.48 | 1.150 | 3.53 | 0.47 | |
| 65 | 300 | 311 | 0.48 | 1.000 | 3.29 | 0.54 | |
| 65 | 300 | 311 | 0.48 | 0.900 | 3.12 | 0.60 | |
| 65 | 300 | 311 | 0.48 | 0.800 | 2.94 | 0.68 | |
| 65 | 300 | 311 | 0.48 | 0.700 | 2.75 | 0.77 | |
| 65 | 300 | 311 | 0.48 | 0.600 | 2.55 | 0.90 | |
| 65 | 300 | 311 | 0.48 | 0.500 | 2.33 | 1.08 | |
| 50 | 225 | 195 | 0.48 | 1.300 | 3.75 | 0.26 | |
| 50 | 225 | 195 | 0.48 | 1.150 | 3.53 | 0.29 | |
| 50 | 225 | 195 | 0.48 | 1.000 | 3.29 | 0.34 | |
| 50 | 225 | 195 | 0.48 | 0.800 | 2.94 | 0.42 | |
| 50 | 225 | 195 | 0.48 | 0.600 | 2.55 | 0.56 | |
| 50 | 225 | 195 | 0.48 | 0.400 | 2.08 | 0.85 | |
| 50 | 225 | 195 | 0.48 | 0.313 | 1.84 | 1.08 | |
| 50 | 150 | 150 | 0.48 | 1.300 | 3.75 | 0.20 | (6) |
| 50 | 150 | 150 | 0.48 | 1.000 | 3.29 | 0.26 | |
| 50 | 150 | 150 | 0.48 | 0.800 | 2.94 | 0.33 | |
| 50 | 150 | 150 | 0.48 | 0.600 | 2.55 | 0.43 | |
| 50 | 150 | 150 | 0.48 | 0.400 | 2.08 | 0.65 | |
| 50 | 150 | 150 | 0.48 | 0.300 | 1.80 | 0.87 | |
| 50 | 150 | 150 | 0.48 | 0.240 | 1.61 | 1.09 | |

Initial sheet length = 4.5 inches

Initial sheet width = 4.125 inches

Number of sheets in roll = 100

Total roll length = 37.5 feet

Footnotes - Table IV (1) A very loose roll, no compression, lots of air spaces, giving an overall low density (2) A roll that theoretically has no compression; this density and volume for roll vs. unrolled would be equal (3) A roll that has been produced, with this compression and roll density (4) Estimate of maximum compression achievable before product failure from in-wound tension exceeding strength of sheets or perforations (5) Physical limitation of the maximum density achievable based on incompressibility of water (6) Low end density achieved by a loose roll, low dry basis weight and low % Add-on The dispensing force should be ideally considerably less than the detach force for a roll of perforated wipes. In this way it is assured that the wipes will be able to be pulled from, or removed from, the dispenser without inadvertently breaking the perforation. Thus, a dispensing force of from about 100 g to about 600 g is contemplated, a dispensing force of from about 150 g to 250 g is further contemplated and ideally a dispensing force of less than 200 g is desirable, with forces based on g/4.25 inches (g/108.0 mm). Normalized, these forces are 23.5 g/inch (0.93 g/mm) to 141.2 g/inch (5.56 g/mm), 35.3 g/inch (1.39 g/mm) to 58.8 g/inch (2.32 g/mm), and 47.1 g/inch (1.85 g/mm).

Generally a peel force of from 80 g–300 g (per 4.25 inches, 108.0 mm) is contemplated, although lower peel forces may be obtained with different types of wipe products. The cartridge adds minimal resistance to the roll as it is unwound. Thus, the force required to unwind a roll is not materially increased by the cartridge. The roll or stack of wipes may also be placed directly in the tray for dispensing, without the use of a cartridge.

FIG. 25 shows the roll 46 as it is placed in a cartridge in a dispenser. The spiral line 70 is intended to represent the manner in which the roll is wound and depicts in that configuration a roll that is being unwound from the bottom. That Figure further shows the relationship of the wiper 24 to the wet web. FIG. 26 shows the roll 46 in cartridge 23, with spiral line 70 indicating the wind of the roll. This Figure shows the relationship of the roll and the ribs 41. As can be seen from this Figure the roll is lifted off of the side and back walls of the cartridge by rib 41. Thus, the amount of surface of the roll that is in contact with the cartridge is reduced. This in turn reduces the drag that the roll experiences from friction with the cartridge when the roll is turned.

FIG. 27 shows a portion of a cartridge 23, the lip 25 of the cartridge, and the side walls 38 and 39. The angle at which the cartridge is positioned has an effect on how well the dispenser will perform. The angle will have a tendency to add or reduce the drag associated with pulling the wipe out. It will have an effect on the amount of siphoning, wicking or drying that may take place in the wet wipe. It may also have an effect on how the roll acts as it is unwound, becoming smaller and smaller in the cartridge. The angle of the cartridge can be measured by the angle that the lip 25 forms with a true in vertical axis, shown as 71. For a dispenser system as shown in FIGS. 24 and 25, the angle 72 that the lip 25 has with a true vertical axis 71 should be from about 10 degrees to about 80 degrees, from about 20 degrees to about 70 degrees, at least greater than 20 degrees, at least smaller than 60 degrees, and preferably about 30 degrees.

Further the angle may be selected such that it balances the forces between the peel forces associated with unrolling the roll and the weight of the roll forcing it down against the ribs. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 72 is increased the difference between the height of the top of the roll and the tail is decreased, thus decreasing any siphoning driving force.

FIGS. 41 to 44 illustrate dispensers 1 that have a rounded member 95 or rounded ridges 96. These components are shown as being part of or attached to the wiper blade assembly 24 and adjacent the wiper blade 74. These components prevent or reduce the tendency of the roll from binding in the gap as the size of the roll decreases.

FIGS. 28 through 33 show an example of a wiper assembly. In this example the wiper comprises a chassis 73, and a wiper blade 74 (74*a* shows sections of blade engaging and protruding through the chassis) that has fingers 75. In this example the fingers are designed to cooperate with the lowered surfaces of the guides 26 in the dispenser. In this example the blade is made of SANTOPRENE® and the chassis is made of polypropylene. A further embodiment of this type of wiper assembly is shown in FIGS. 36 to 40. This embodiment contains raised or thicker areas 97 of the wiper blade. These raised areas cooperate with the guides 26 on the tray.

Figure 34:
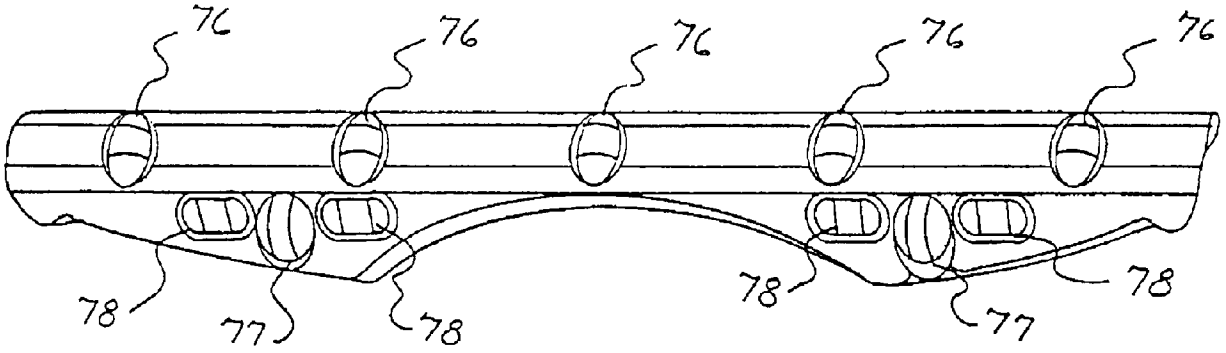
FIGS. 34–35 are views of a wiper.
Figure 35:
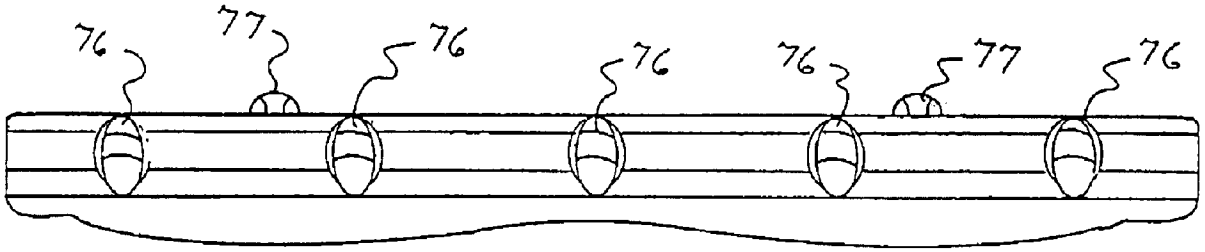
Figure 37:
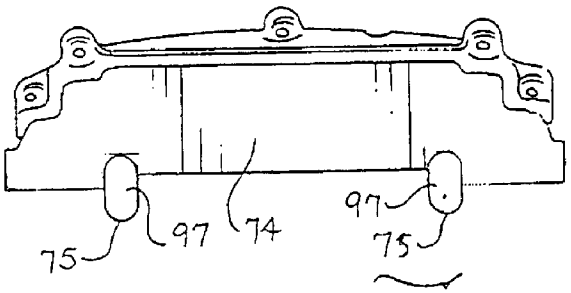
FIG. 37 is a front plan view of a wiper assembly.
Figure 36:
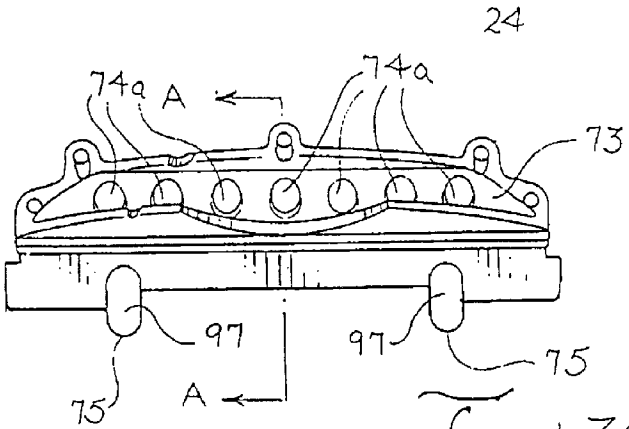
FIG. 36 is a front plan view of a wiper assembly.
Figure 40:
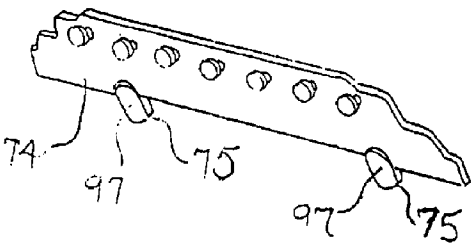
FIG. 40 is a perspective view of a wiper blade.
Figure 39:
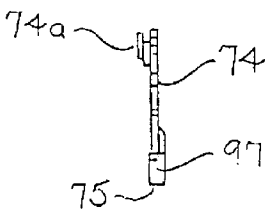
FIG. 39 is a cross-sectional view of a wiper blade.
Figure 38:
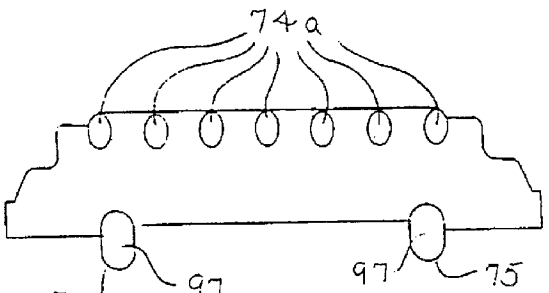
FIG. 38 is a plan view of a wiper blade.
Figure 41:
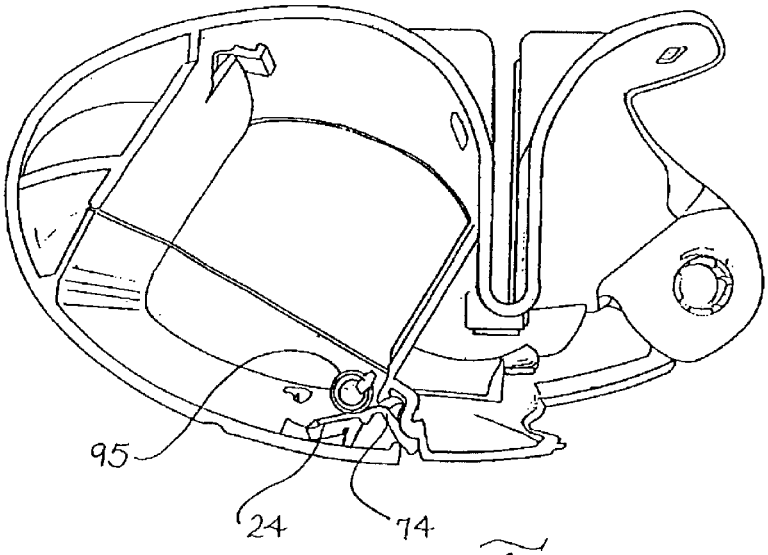
FIG. 41 is a cross-sectional view of a dispenser.
Figure 42:
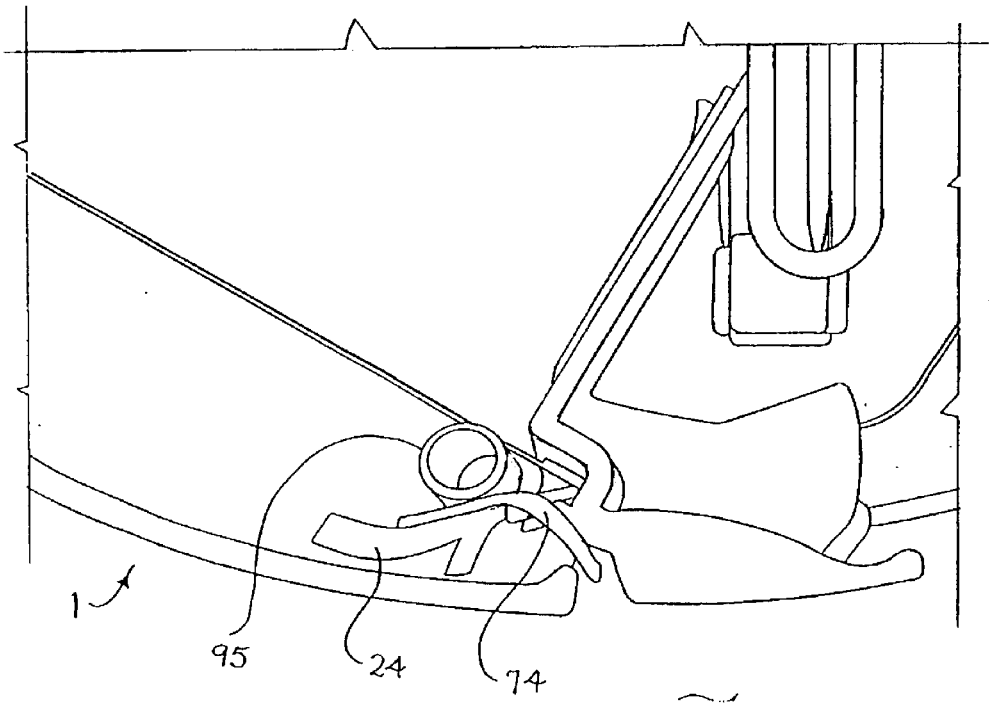
FIG. 42 is a cross-sectional view of a portion of a dispenser.

FIGS. 34 and 35 show an example of a wiper blade. In this example the wiper blade is formed of a single piece (see FIG. 34) of material that is folded over to form the wiper blade (see FIG. 35). The wiper blade has raised portions 76 that reduce the amount of surface area of the wiper blade that contacts the sheet and raised areas 77 and lowered areas 78 that cooperate with the raised and lowered areas of the guides.

Wiper blades may be made out of any flexible material, such as thermoplastic elastomers, foam, sponge, plastic, or rubber having a shore A durometer hardness value ranging about 0 to 80, from about 15 to about 70 and preferably from about 30 to about 60. It is further preferred that the wiper blades be made from a material that will form a good moisture and contamination barrier. Examples of preferred types of material are SANTOPRENE®, Kraton®, silicone, or styrene-ethylene/butylene-styrene (SEBS). The wiper blade material has a Gurley stiffness value (ASTM D 6125-97) between about 100 mg to 8000 mg, preferably between about 200 mg to 6000 mg, and more preferably between about 400 mg to 3000 mg. The force applied to the wipe by the wiper blade when pulling the wipe from the dispenser should not be greater than the tensile strength of the wipe that is not perforated and not greater than the perforation tensile strength of a perforate wipe. Antibacterial agents may be added to the materials that makes up the wiper assembly.

The wiper blade is designed to function with the guides and the tray and to a limited extent the lip of the cartridge. Depending on the placement of the wiper, it could have greater or lesser interaction with these components of the dispensing system. The gap between the end of the wiper blade and the tray may be varied depending upon the thickness of the wet wipes and how much drag is need for the dispensing system to function as desired. The wiper blade can help to hold the tail of the wipe in place and thus keep the tail from falling back through the gap and into the cartridge. The force applied to the wipe by the wiper when pulling the wipe from the dispenser should not be greater than the tensile strength of the wipe in the non-perforated region and not greater than the perforation tensile strength of a perforated wipe. If the wipes are made such that they are dry in storage and become wet during use, the blade may be configured to exert pressure on the wipe. In this case, the dispensing of a sheet or sheets causes sufficient shear to be applied to the wipe to permit the moisture to be released. For example, this force or shear may be sufficient to cause microcapsules of fluid to burst or may be sufficient to rupture a protective emulsion which contains the fluid.

In a further embodiment of this invention, the system may have a dispenser that has a cover, which is capable of being mounted to a surface, such as a wall, a cabinet, an existing bath tissue dispenser, a toilet, a toilet tank, a stall wall, or a dashboard of an automobile. It is also advantageous to mount the dispenser without the use of fasteners and/or adhesives. This method of mounting avoids permanent modification of the wall and eliminates the need for tools to be used in the mounting process. The dispenser has an opening that holds a cartridge, which contains the wet wipes. These cartridges are sealed and may be grouped in packages of multiple cartridges. Thus, a package of cartridges may be provided to a user. The user may then select and open one of the cartridges, put it in the dispenser, and use the wipes as needed. When the wipes are used up, the user may simply discard the old cartridge and replace it with a new one. This system enables the user to conveniently obtain and keep several cartridges of wipes on hand and then use the wipes as needed. By using sealed cartridges to refill the dispenser the user is using a new and fresh product each time and a product that is in contact with fresh surfaces.

FIG. 45 depicts a conventional bath tissue holder 85 that is the partially recessed type, having posts 86. FIG. 46 depicts a conventional bath tissue holder 85 that is not recessed and having posts 86 and a roller 6. FIG. 47 illustrates the holder of FIG. 46 with the roller removed and a mounting assembly 4 engaged with the post 86. In actual use the mounting assembly 4 would be joined with a dispenser, as shown for example in FIG. 5, and secured.

Figure 48:
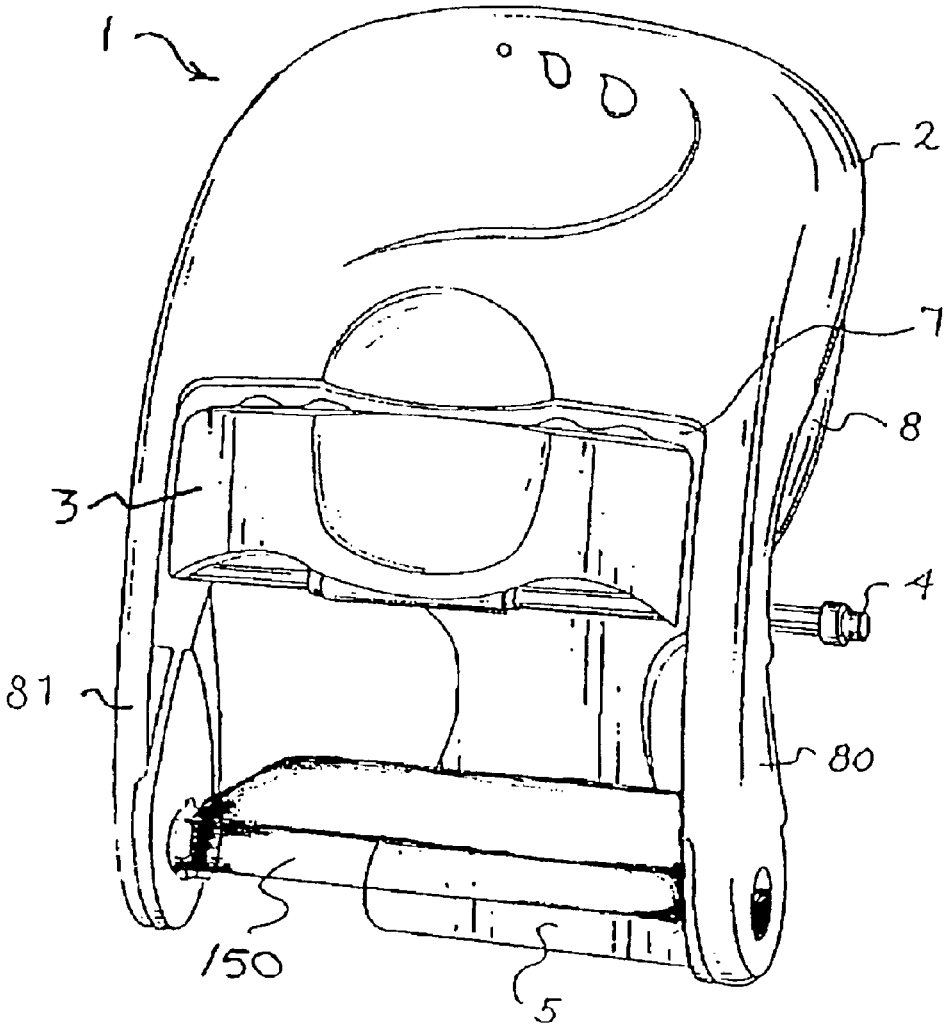
FIG. 48 is a perspective front view of a dispenser.

FIG. 48 depicts yet another embodiment of the invention. A shelf 150 may be included between arms 80 and 81 as an alternative to a conventional toilet paper roll holder. The shelf may be mounted for fixed or removable positioning between the arms 80 and 81, and the shelf 150 may even have protrusions projected outwards from its ends to engage the holes in arms 80 and 81 which are adapted to receive a conventional paper roll holder. The shelf can thereby provide a use and space for other items thereupon if the dispenser user no longer desires to mount a roll type product between arms 80 and 81. Shelf 150 may be fixedly or removably connected at a back portion thereof to mounting plate 5 in order to prevent rotation of the shelf.

We claim:

1. A dispensing system for dispensing wet wipes comprising:

a dispenser;

wet wipes, the wet wipes having a length and a width; and a gap, the gap allowing for dispensing of the wet wipes;

the dispenser and wet wipes together having a dispensing force, and the wet wipes having a tensile strength which is at least twice that of the dispensing force.

2. The dispensing system of claim 1, wherein the wet wipes have a tensile strength at least five times that of the dispensing force.

3. The dispensing system of claim 1, wherein the wet wipes have a tensile strength at least seven times that of the dispensing force.

4. The dispensing system of claim 1, wherein the wet wipes have a tensile strength along the length of at least 300 g/in.

5. The dispensing system of claim 1, wherein the wet wipes have a tensile strength along the length between about 300 and 600 g/in.

6. The dispensing system of claim 1, wherein the wet wipes have a tensile strength along the width of at least 250 g/in.

7. The dispensing system of claim 1, wherein the wet wipes have a tensile strength along the width of between about 250 and 500 g/in.

8. The dispensing system of claim 1, wherein the wet wipes have a peel force, the peel force contributing to the dispensing force.

9. The dispensing system of claim 1, wherein the wet wipes have a peel force between about 18 and 70 g/in.

10. The dispensing system of claim 1, wherein the wet wipes have a peel force between about 20 and 40 g/in.

11. The dispensing system of claim 1, wherein the dispenser contributes to the dispensing force such that the dispensing force is between about 20 and 150 g/in.

12. The dispensing system of claim 1, wherein the dispenser contributes to the dispensing force such that the dispensing force is between about 30 and 60 g/in.

13. The dispensing system of claim 1, wherein the dispenser contributes to the dispensing force such that the dispensing force is less than about 47 g/in.

14. The dispensing system of claim 1, wherein the wet wipes are configured in a roll.

15. The dispensing system of claim 1, wherein the wet wipes are configured in a roll, the roll being coreless.

16. The dispensing system of claim 1, wherein the wet wipes comprise perforations.

17. A dispensing system for dispensing wet wipes comprising:

a dispenser;

wet wipes, the wet wipes having perforations; and a gap, the gap allowing for dispensing of the wet wipes;

the dispenser and wet wipes together having a dispensing force, and the wet wipes having a detach strength which is at least twice that of the dispensing force.

18. The dispensing system of claim 17, wherein the wet wipes are configured in a roll.

19. The dispensing system of claim 17, wherein the wet wipes are configured in a roll, the roll being coreless.

20. The dispensing system of claim 17, wherein the wet wipes comprise perforated sheets.

21. The dispensing system of claim 17, wherein the wet wipes have perforations, the perforations having a bond length, a cut length, and a bond spacing.

22. The dispensing system of claim 17, wherein the wet wipes have perforations, the perforations having a bond length of 0.01 inches, a cut length of 0.03 inches, and a bond spacing of 0.04 inches.

23. The dispensing system of claim 17, wherein the wet wipes have perforations, the perforations having a bond length of 0.02 inches, a cut length of 0.05 inches, and a bond spacing of 0.07 inches.

24. The dispensing system of claim 17, wherein the wet wipes have perforations, the perforations having a bond length of 0.04 inches, a cut length of 0.09 inches, and a bond spacing of 0.13 inches.

25. The dispensing system of claim 17, wherein the wet wipes have a detach strength at least five times that of the dispensing force.

26. The dispensing system of claim 17, wherein the wet wipes have a detach strength at least seven times that of the dispensing force.

27. The dispensing system of claim 17, wherein the wet wipes have a tensile strength along the length of at least 300 g/in.

28. The dispensing system of claim 17, wherein the wet wipes have a tensile strength along the length between about 350 and 500 g/in.

29. The dispensing system of claim 17, wherein the dispenser contributes to the dispensing force such that the dispensing force is between about 20 and 150 g/in.

30. The dispensing system of claim 17, wherein the dispenser contributes to the dispensing force such that the dispensing force is between about 30 and 60 g/in.

31. The dispensing system of claim 17, wherein the dispenser contributes to the dispensing force such that the dispensing force is less than about 47 g/in.

* * * * *